US005415985A

United States Patent [19]

Sakai et al.

[11] Patent Number: 5,415,985

[45] Date of Patent: May 16, 1995

[54] SILVER HALIDE COLOR PHOTOGRAPHIC MATERIAL

[75] Inventors: Hidekazu Sakai; Yasuhiro Shimada, both of Minami Ashigara, Japan

[73] Assignee: Fuji Photo Film Co., Ltd., Kanagawa, Japan

[21] Appl. No.: 52,685

[22] Filed: Apr. 27, 1993

[30] Foreign Application Priority Data

Apr. 27, 1992 [JP] Japan ..... 4-131368

[51] Int. Cl.[6] ..... G03C 1/46

[52] U.S. Cl. ..... 430/503; 430/384; 430/385; 430/558; 430/548; 430/546; 430/567

[58] Field of Search ..... 430/558, 384, 385, 503, 430/548, 546, 567

[56] References Cited

U.S. PATENT DOCUMENTS

| | | | |
|---|---|---|---|
| 4,873,183 | 10/1989 | Tachibana et al. | 430/385 |
| 4,916,051 | 4/1990 | Tachibana et al. | 430/385 |
| 4,950,585 | 8/1990 | Tachibana et al. | 430/385 |
| 5,091,297 | 2/1992 | Fukunaga et al. | 430/385 |
| 5,164,289 | 11/1992 | Shimada et al. | 430/384 |
| 5,206,130 | 4/1993 | Shimada et al. | 430/385 |
| 5,215,871 | 6/1993 | Sato et al. | 430/384 |
| 5,256,526 | 10/1993 | Suzuki et al. | 430/384 |
| 5,270,153 | 12/1993 | Suzuki et al. | 430/384 |

FOREIGN PATENT DOCUMENTS 0488248 6/1992 European Pat. Off. .

OTHER PUBLICATIONS

Technical Photograph Handbook (New Edition), pp. 522–523, Corona Publishing Co., Ltd., 1987.

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

Disclosed is a silver halide color photographic material which contains at least one pyrroloazole compound as cyan coupler and has a layer structure in which a cyan coupler-containing silver halide emulsion layer is disposed in the position nearer to a support than at least either a magenta coupler-containing silver halide emulsion layer or a yellow coupler-containing silver halide emulsion layer, whereby ensuring excellent color reproducibility and high fastness in color images.

20 Claims, No Drawings

SILVER HALIDE COLOR PHOTOGRAPHIC MATERIAL

FIELD OF THE INVENTION

The present invention relates to a silver halide color photographic material and, more particularly, to a silver halide photographic material whose color reproducibility, color image stability and color formability are improved so that it can provide photographs of excellent quality, especially fit for artistic appreciation.

BACKGROUND OF THE INVENTION

A silver halide color photographic material has, in general, three kinds of silver halide emulsion layers which are different in color sensitivity. Color images are reproduced by the so-called subtractive color process, or the method of developing yellow, magenta and cyan colors of color couplers (abbreviated as "couplers") incorporated in the emulsion layers. The color images obtained by subjecting such a silver halide color photographic material to development-processing generally consist of azomethine dyes or indoaniline dyes produced by the reaction of couplers with the oxidation product of an aromatic primary amine developing agent. To ensure satisfactory color reproducibility, intensive research has been done on couplers which can form clear dyes having reduced side absorption.

In silver halide color photographic materials as described above, phenol or naphthol derivatives have hitherto been used as prevalent cyan dye-forming couplers (abbreviated as "cyan coupler", hereinafter). However, the dyes formed from these couplers have undesirable absorption in blue and green regions, so that considerable deterioration in color reproducibility is a serious problem of said couplers. With the intention of overcoming the weaknesses of conventionally used couplers, the following ones are proposed.

For instance, 2,4-diphenylimidazoles are disclosed in EP 0 249 453 A2. Since the dyes formed from those couplers are weak in undesirable absorption on the shorter wavelength side, compared with dyes formed from conventional couplers, they are in the direction desirable for color reproduction. However, the color reproducibility of such couplers is not highly satisfactory, and they still have problems in practical use, such as their coupling activities are low, their fastness to heat and light are considerably low, and so on.

Pyrazoloazoles are disclosed in JP-A-64-552 (the term "JP-A" as used herein means an "unexamined published Japanese patent application"), JP-A-64-553, JP-A-64-554, JP-A-64-555, JP-A-64-556 and JP-A-64-557. Although the dyes formed from those couplers are reduced in absorption in the shorter wavelength side, compared with conventional dyes, the extent of the reduction is not sufficient for color reproduction. In addition, such compounds do not have sufficient color formability as cyan couplers, so that a practical problem exists.

The present inventors have already proposed pyrroloazoles as another type of cyan dye-forming couplers with mitigated drawbacks. Specifically, the cyan couplers of pyrroloazole type are high in coupling activity, and are remarkably improved over conventional ones with respect to the absorption characteristic on the shorter wavelength side, such that production of such dyes is highly desirable for color reproduction. In addition, the dyes formed from the couplers of this type have higher extinction coefficients than those formed from conventional couplers, so that these couplers are superior because they provide an intended density of developed color at a smaller coverage than conventional couplers. However, the fastness, particularly to light, of such dyes in photosensitive materials is still unsatisfactory in a practical sense. (Making an additional remark, the couplers containing 1H-pyrrolo[1,2-b][1,2,4]triazole as a mother nucleus are described in the notes of lectures at the annual convention of Japanese Photographic Society in the 60th year of Showa (held on May 23 and 24 in 1985, at Shigaku Kaikan), pages 108–110, and disclosed in JP-A-62-279339 and JP-A-62-278552. However, those couplers are known as magenta couplers, and the dyes produced therefrom have their absorption maxima in the green region although they have slight side absorption.)

The above-described problems of fading and discoloration of color images are of great importance in color photosensitive materials used for artistic purposes. It has been proposed to use discoloration inhibitors to solve the fading and discoloration problems, ultraviolet absorbents for the purpose of preventing deterioration in image quality caused by ultraviolet rays, and so on.

As known inhibitors described above, there are hydroquinones, hindered phenols, catechols, gallic acid esters, aminophenols, hindered amines, chromanols, indanes, the ethers or esters obtained by silylating, acylating or alkylating the phenolic OH group in each of the above-cited compounds, metal complex salts and so on.

However, those compounds are still insufficient in effects, although their effects as inhibitors against the fading and discoloration of color images are appreciable. In addition, some of them cause a change in hue, generate fog, are poor in dispersibility, or deposit microcrystals after the coating of emulsions. Therefore, color photographs with excellent comprehensive properties cannot yet be ensured by the use of discoloration inhibitors alone.

It was found that when a multilayer color photosensitive material was designed so as to arrange the silver halide emulsion layer containing a pyrroloazole type cyan coupler in the position farthest from the support, said cyan couplers have a problem of the maximal densities of colors developed in the silver halide emulsion layers containing magenta and yellow couplers respectively, which are present nearer to the support than the foregoing cyan coupler containing emulsion layer, are lower than those obtained by the use of conventional cyan couplers.

Therefore, it has been desired to make further improvements upon the silver halide color photographic materials containing couplers of the above-described type which meet recent demands for high standards of processability, color formability, fastness and so on.

SUMMARY OF THE INVENTION

An object of the present invention is to provide a silver halide color photographic material which has excellent color reproducibility and ensures high fastness in the color images.

Another object of the present invention is to provide a silver halide color photographic material which is well balanced in color formation among the silver halide emulsion layers and ensures excellent color reproducibility and high fastness in the color images.

A further object of the present invention is to provide a silver halide color photographic material, especially fit for artistic appreciation purposes, which has an aptitude for rapid processing and ensures excellent color reproducibility and fastness in the color images.

As a result of our intensive studies, it has now been found that the above-described subjects can be solved satisfactorily with a silver halide color photographic material having on a support at least a cyan coupler-containing silver halide emulsion layer, a magenta coupler-containing silver halide emulsion layer and a yellow coupler-containing silver halide emulsion layer, said cyan coupler-containing silver halide emulsion layer being present in a position nearer to the support than at least either the magenta coupler-containing silver halide emulsion layer or the yellow coupler-containing silver halide emulsion layer and containing as said cyan coupler at least one compound represented by the following general formula (Ia):

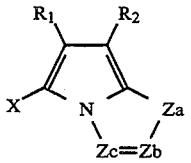

(Ia)

wherein Za represents —NH— or —CH($R_3$)—; Zb and Zc each represent —C($R_4$)= or —N=; $R_1$, $R_2$ and $R_3$ each represent an electron-withdrawing group having a Hammett's substituent constant $\sigma_p$ of at least 0.20, provided that the sum of the $\sigma_p$ values of $R_1$ and $R_2$ is at least 0.65; $R_4$ represents a hydrogen atom or a substituent group, and when two $R_4$'s are present in the formula they may be the same or different; and X represents a hydrogen atom or a group capable of splitting off by the coupling reaction with the oxidation product of an aromatic primary amine color developing agent.

When a bleach-fix bath is used in a desilvering process during processing, the conventional cyan couplers tend to have reduction discoloration and reduce the developed color density. Further, as the conventional cyan coupler-containing layer is positioned nearer to the support than other constituting layer(s), the reduction discoloration tends to be generated. The present inventors have found that the cyan couplers of the present invention do not have such a problem and further can improve light fastness remarkably. These findings are new and remarkable.

DETAILED DESCRIPTION OF THE INVENTION

Compounds used in the present invention are described below in detail.

The present cyan couplers of general formula (Ia) specifically include those represented by the following general formulae (IIa) to (IXa):

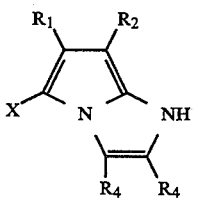

(IIa)

-continued

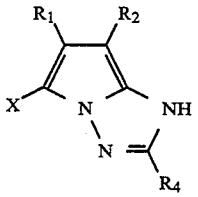

(IIIa)

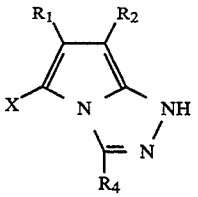

(IVa)

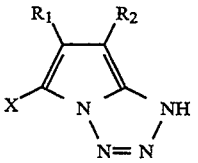

(Va)

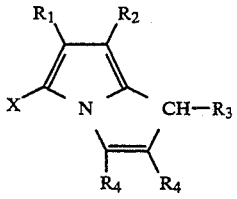

(VIa)

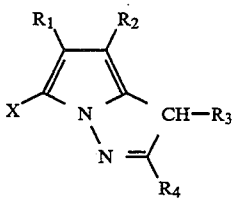

(VIIa)

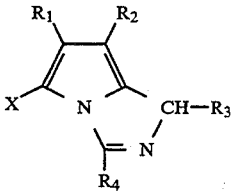

(VIIIa)

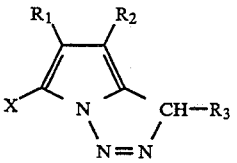

(IXa)

wherein $R_1$, $R_2$, $R_3$, $R_4$ and X have the same meanings as in general formula (Ia), respectively.

The cyan couplers which are preferable in the present invention are those represented by general formulae (IIa), (IIIa) and (IVa), especially those represented by general formula (IIIa).

In the foregoing general formulae, $R_1$, $R_2$ and $R_3$ are each an electron withdrawing group having a Hammett's substituent constant $\sigma_p$ of at least 0.20, preferably at least 0.35, and more preferably at least 0.60. With respect to the $\sigma_p$ value, the electron withdrawing group has an upper limit of no greater than 1.0. Moreover, the sum of the $\sigma_p$ values of $R_1$ and $R_2$ is at least 0.65, preferably at least 0.70, and a desirable upper limit thereof is around 1.8. The Hammett's rule is the empirical rule proposed by L. P. Hammett in 1935 in order to treat quantitatively the effects of substituent groups upon the reaction of the equilibrium of benzene derivatives, and its validity is universally appreciated in these times. The substituent constants determined by Hammett's rule are $\sigma_p$ and $\sigma_m$ values. We can find the description of these values in many general books. For instance, there are detailed descriptions in J. A. Dean, *Lange's Handbook of Chemistry,* 12th edition, McGraw-Hill (1979), and *Kagaku no Ryo-iki Zokan* (which means special numbers of "Domain of Chemistry"), number 122, pages 96–103, Nankodo, Tokyo (1979). In the present invention, $R_1$, $R_2$ and $R_3$ are specified definitely using a Hammett's substituent constant $\sigma_p$. These substituents should not be construed as being limited to the substituents whose $\sigma_p$ values are already known through the references in the above-cited books; it is a matter of course that they include any substituents whose $\sigma_p$ values are within the range defined by the present invention when determined by Hammett's rule even if they are not yet reported in the literature.

Specific examples of electron withdrawing groups having a $\sigma_p$ value of at least 0.20, which are represented by $R_1$, $R_2$ and $R_3$, include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenoalkyl group, a halogenoalkoxy group, a halogenoaryloxy group, a halogenoalkylamino group, a halogenoalkylthio group, an aryl group substituted with other electron withdrawing groups having a $\sigma_p$ value of at least 0.20, a heterocycle group, a halogen atom, an azo group, and a selenocyanate group. These groups may further have substituents such as examples of the group represented by $R_4$ described hereinafter, provided that they have room for substituent groups.

More specifically describing $R_1$, $R_2$ and $R_3$, the electron withdrawing groups whose $\sigma_p$ values are at least 0.20 include an acyl group (e.g., acetyl, 3-phenylpropanoyl, benzoyl, 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido)phenylcarbamoyl, N-methyl-N-dodecylcarbamoyl, N-{3-(2,4-di-tert-amylphenoxy)-propyl}carbamoyl), an alkoxycarbonyl group (e.g., methoxycarbonyl, ethoxycarbonyl, iso-propyloxycarbonyl, tert-butyloxycarbonyl, iso-butyloxycarbonyl, butyloxycarbonyl, dodecyloxycarbonyl, octadecyloxycarbonyl, diethylcarbamoylethoxycarbonyl, perfluorohexylethoxycarbonyl, 2-decyl-hexyloxycarbonylmethoxycarbonyl), an aryloxycarbonyl group (e.g., phenoxycarbonyl, 2,5-diamylphenoxycarbonyl), a cyano group, a nitro group, a dialkylphosphono group (e.g., dimethylphosphono), a diarylphosphono group (e.g., diphenylphosphono), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl, octanesulfonyl), an arylsulfonyl group (e.g., benzenesulfonyl, toluenesulfonyl), a sulfonyloxy group (e.g., methanesulfonyloxy, toluenesulfonyloxy), an acylthio group (e.g., acetylthio, benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a thiocyanate group, a thiocarbonyl group (e.g., methylthiocarbonyl, phenylthiocarbonyl), a halogenoalkyl group (e.g., trifluoromethyl, heptafluoropropyl), a halogenoalkoxy group (e.g., trifluoromethoxy), a halogenoaryloxy group (e.g., pentafluorophenoxy), a halogenoaryl group, a halogenoalkylamino group (e.g., N,N-di-(trifluoromethyl)amino), a halogenoalkylthio group (e.g., difluoromethylthio, 1,1,2,2-tetrafluoroethylthio), an aryl group substituted with other electron withdrawing groups having a $\sigma_p$ value of at least 0.20 (e.g., 2,4-dinitrophenyl, 2,4,6-trichlorophenyl, pentachlorophenyl), a heterocycle group (e.g., 2-benzoxazolyl, 2-benzothiazolyl, 1-phenyl-2-benzimidazolyl, 5-chloro-1-tetrazolyl, 1-pyrrolyl), a halogen atom (e.g., chlorine, bromine), an azo group (e.g., phenylazo) and selenocyanate group.

As for the representative electron withdrawing groups, their $\sigma_p$ values are given below in parenthesis after the corresponding groups: Cyano group (0.66), nitro group (0.78), trifluoromethyl group (0.54), acetyl group (0.50), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), pyrazolyl group (0.37), methanesulfonyloxy group (0.36), dimethoxyphosphoryl group (0.60), sulfamoyl group (0.57), and so on.

Substituent groups desirable for $R_1$, $R_2$ and $R_3$ include an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenoalkyl group, a halogenoalkoxy group, a halogenoalkylthio group, a halogenoaryloxy group, a halogenoaryl group, an aryl group substituted with at least two nitro groups, and a heterocyclyl group. Of these groups, preferable ones are an acyl group, an alkoxycarbonyl group, an aryloxycarbonyl group, a nitro group, a cyano group, an arylsulfonyl group, a carbamoyl group and a halogenoalkyl group. More preferable ones are a cyano group, an alkoxycarbonyl group, an aryloxycarbonyl group and a halogenoalkyl group.

In particular, a cyano group, a trifluoromethyl group, an unsubstituted alkoxycarbonyl group, an alkoxycarbonyl group substituted with a carbamoyl group (these alkoxy moieties may contain an ether linkage, and it is desirable that the alkoxy moiety of the unsubstituted alkoxycarbonyl group have a branched chain), an unsubstituted aryloxycarbonyl group and an aryloxycarbonyl group substituted with alkyl or alkoxy group(s) are preferred over others.

With respect to the combination of $R_1$ and $R_2$, it is preferable that $R_1$ be a cyano group and $R_2$ be a trifluoromethyl group, an unsubstituted alkoxycarbonyl group as defined above, an alkoxycarbonyl group substituted with a carbamoyl group, an unsubstituted aryloxycarbonyl group or an aryloxycarbonyl group substituted with alkyl or alkoxy group(s).

$R_4$ represents a hydrogen atom or a substituent group (including an atom). Specific examples of the substituent group include a halogen atom, an aliphatic group, an aryl group, a heterocyclyl group, an alkoxy group, an aryloxy group, a heterocyclyloxy group, an alkyl-, aryl- or heterocyclylthio group, an acyloxy group, a carbamoyloxy group, a silyloxy group, a sulfonyloxy group, an acylamino group, an alkylamino group, an arylamino group, a ureido group, a sulfamoylamino group, an alkenyloxy group, a formyl group, an alkyl-, aryl- or heterocyclylacyl group, an alkyl-, aryl or heterocyclylsulfonyl group, an alkyl-, aryl- or heterocyclylsulfinyl group, an alkyl-, aryl- or heterocyclyloxycarbonyl group, an alkyl-, aryl- or heterocyclyloxycarbonylamino group, a sulfonamido group, a carbamoyl group, a sulfamoyl group, a phosphonyl group, a sulfamido group, an imido group, an azolyl group, a hydroxy group, a cyano group, a carboxyl group, a nitro group, a sulfo group and an unsubstituted amino group. The alkyl, aryl or heterocyclyl moieties contained in the above-cited groups may further be substituted with group(s) as instanced in the description of $R_4$.

More specifically, $R_4$ represents a hydrogen atom, a halogen atom (e.g., chlorine, bromine), an aliphatic group (including straight-chain or branched alkyl, aralkyl, alkenyl, alkynyl, cycloalkyl and cycloalkenyl groups which each contain 1 to 36 carbon atoms, such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]-dodecanamido}phenyl}propyl, 2-ethoxytridecyl, trifluoromethyl, cyclopentyl, 3-(2,4-di-t-amylphenoxy)propyl), an aryl group (preferably containing 6 to 36 carbon atoms, e.g., phenyl, naphthyl, 4-hexadecoxyphenyl, 4-t-butylphenyl, 2,4-di-t-amylphenyl, 4-tetradecanamidophenyl, 3-(2,4-tert-amylphenoxyacetamido)phenyl), a heterocyclyl group (e.g., 3-pyridyl, 2-furyl, 2-thienyl, 2-pyridyl, 2-pyrimidinyl, 2-benzothiazolyl), an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, 3-methoxycarbamoylphenoxy), a heterocyclyloxy group (e.g., 2-benzimidazolyloxy, 1-phenyltetrazole-5-oxy, 2-tetrahydropyranyloxy), an alkyl-, aryl- or heterocyclylthio group (e.g., methylthio, ethylthio, octylthio, tetradecylthio, 2-phenoxyethylthio, 3-phenoxypropylthio, 3-(4-tert-butylphenoxy)propylthio, phenylthio, 2-butoxy-5-tert-octylphenylthio, 3-pentadecylphenylthio, 2-carboxyphenylthio, 4-tetradecanamidophenylthio, 2-benzothiazolylthio, 2,4-di-phenoxy-1,3,4-triazole-6-thio, 2-pyridylthio), an acyloxy group (e.g., acetoxy, hexadecanoyloxy), a carbamoyloxy group (e.g., N-ethylcarbamoyloxy, N-phenylcarbamoyloxy), a silyloxy group (e.g., trimethylsilyloxy, dibutylmethylsilyloxy), a sulfonyloxy group (e.g., dodecylsulfonyloxy), an acylamino group (e.g., acetamido, benzamide, tetradecanamido, 2-(2,4-tert-amylphenoxyacetamido, 2-[4-(4-hydroxyphenylsulfonyl)phenoxy]-decanamido, isopentadecanamido, 2-(2,4-di-t-amylphenoxy)butanamido, 4-(3-t-butyl-4-hydroxyphenoxy)-butanamido), an alkylamino group (e.g., methylamino, butylamino, dodecylamino, dimethylamino, diethylamino, methylbutylamino), an arylamino group (e.g., phenylamino, 2-chloroanilino, 2-chloro-5-tetradecanamidoanilino, N-acetylanilino, 2-chloro-5-(α-2-tert-butyl-4-hydroxyphenoxy)dodecanamido)anilino, 2-chloro-5-dodecyloxycarbonylanilino), a ureido group (e.g., methylureido, phenylureido, N,N-dibutylureido, dimethylureido), a sulfamoylamino group (e.g., N,N-dipropylsulfamoylamino, N-methyl-N-decylsulfamoylamino), an alkenyloxy group (e.g., 2-propenyloxy), a formyl group, an alkyl-, aryl- or heterocyclylacyl group (e.g., acetyl, benzoyl, 2,4-di-tert-amylphenylacetyl, 3-phenylpropanoyl, 4-dodecyloxybenzoyl), an alkyl-, aryl- or heterocyclylsulfonyl group (e.g., methanesulfonyl, octanesulfonyl, benzenesulfonyl, toluenesulfonyl), an alkyl-, aryl- or heterocyclyl sulfinyl group (e.g., octanesulfinyl, dodecylsulfinyl, dodecanesulfinyl, phenylsulfinyl, 3-pentadecylphenylsulfinyl, 3-phenoxypropylsulfinyl), an alkyl-, aryl- or heterocyclyloxycarbonyl group (e.g., methoxycarbonyl, butoxycarbonyl, dodecyloxycarbonyl, octadecyloxycarbonyl, phenoxycarbonyl, 2-pentadecyloxycarbonyl), an alkyl-, aryl- or heterocyclyloxycarbonylamino group (e.g., methoxycarbonylamino, tetradecyloxycarbonylamino, phenoxycarbonylamino, 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, 2-methoxy-5-tert-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-[3-(2,4-di-tert-amylphenoxy)propyl]carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a phosphonyl group (e.g., phenoxyphosphonyl, octyloxyphosphonyl, phenylphosphonyl), a sulfamido group (e.g., dipropylsulfamoylamino), an imido group (e.g., N-succinimido, hydantoinyl, N-phthalimido, 3-octadecenylsuccinimido), an azolyl group (e.g., imidazolyl, pyrazolyl, 3-chloro-pyrazole-1-yl, triazolyl), a hydroxyl group, a cyano group, a carboxyl group, a nitro group, a sulfo group, an unsubstituted amino group, or so on.

Groups preferred as $R_4$ are an alkyl group, an aryl group, a heterocyclyl group, a cyano group, a nitro group, an acylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocyclyloxy group, an acyloxy group, a carbamoyloxy group, an aryloxycarbonylamino group, an imido group, a heterocyclylthio group, a sulfinyl group, a phosphonyl group, an acyl group and an azolyl group.

Of these groups, an alkyl group and an aryl group are more preferable. Further, it is desirable for these groups to be substituted with at least one alkoxy, sulfonyl, sulfamoyl, carbamoyl, acylamido or sulfonamido group. Especially preferred group as $R_4$ is an alkyl or aryl group containing at least one acylamido or sulfamido group as a substituent.

X in general formula (Ia) represents a hydrogen atom or a group capable of splitting off when the coupler reacts with the oxidation product of an aromatic primary amine color developing agent (the group is abbreviated as "a splitting-off group"). When X represents a splitting-off group, the splitting-off group includes a halogen atom; an aromatic azo group; an alkyl, aryl, heterocyclyl, alkyl- or arylsulfonyl, arylsulfinyl, alkyl-, aryl- or heterocyclyl oxycarbonyl, or alkyl-, aryl- or heterocyclylcarbonyl group which is attached to the coupling active site via an oxygen, nitrogen, sulfur or carbon atom; and a heterocyclyl group which is attached to the coupling active site via the nitrogen atom thereof. Specifically, a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclylthio group, a carbamoylamino group, an arylsulfinyl group, an arylsulfonyl group, a 5- or 6-membered nitrogen-containing heterocyclyl group, an imido group and an arylazo group are examples of the splitting-off group. The alkyl, aryl or heterocyclyl moiety contained in the above-cited groups may further be substituted with group(s) included in specific examples of $R_4$. When such a moiety has two or more substituents, the substituents may be the same or different and may further have such a substituent as instanced in the description of $R_4$.

More specifically, the splitting-off group includes a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutyrylamino), an alkyl- or arylsulfonamido group (e.g., methanesulfonamido, trifluoromethanesulfonamido, p-toluenesulfonylamino), an alkoxycarbonyloxy group (e.g., ethoxycarbonyloxy, benzyloxycarbanyloxy), an aryloxycarbonyloxy group (e.g., phenoxycarbonyloxy), an alkyl-, aryl or heterocyclylthio group (e.g., ethylthio, 2-carboxyethylthio, dodecylthio, 1-carboxydodecylthio, phenylthio, 2-butoxy-5-t-octylphenylthio, tetrazolylthio), an arylsulfonyl group (e.g., 2-butoxy-5-tert-octylphenylsulfonyl), an arylsulfinyl group (e.g., 2-butoxy-5-tert-octylphenylsulfinyl), a carbamoylamino group (e.g., N-methylcarbamoylamino, N-phenylcarbamoylamino), a 5- or 6-membered nitrogen-containing heterocyclyl group (e.g., imidazolyl, pyrazolyl, triazolyl, tetrazolyl, 1,2-dihydro-2-oxo-1-pyridyl), an imido group (e.g., succinimido, hydantoinyl), an arylazol group (e.g., phenylazo, 4-methoxyphenylazo) and so on. Of course, these groups may further be substituted with substituent(s) instanced in the description of $R_4$. In addition, splitting-off groups of the type which are attached to the coupling site via a carbon atom include those which constitute bis-type couplers formed by condensing four-equivalent couplers through aldehydes or ketones. The splitting-off groups used in the present invention may contain a photographically useful group, such as a development inhibitor residue, a development accelerator residue or so on.

It is preferable for X to be a halogen atom, an alkoxy group, an aryloxy group, an alkyl- or arylthio group, an arylsulfonyl group, an arylsulfinyl group or a 5- or 6-membered nitrogen-containing heterocyclyl group which is attached to the coupling active site via the nitrogen thereof. Of the above-cited groups, an arylthio group is much preferable.

The cyan coupler represented by general formula (Ia) may be a dimer or higher polymer formed by containing one or more residues of the cyan coupler of general formula (Ia) in the substituent group $R_1$, $R_2$, $R_3$, $R_4$ or X, or may be a homo- or copolymer by containing a high molecular chain in the substituent group $R_1$, $R_2$, $R_3$, $R_4$ or X. The expression "a homo-or copolymer formed by containing a high molecular chain" as used herein is intended to include, as typical examples, polymers consisting of or comprising addition-polymerizable ethylenic unsaturated compounds containing a residue of the cyan coupler represented by general formula (Ia). Herein, the cyan color-forming repeating units present in a polymer molecule may not be the same, provided that they are a residue of the cyan coupler represented by general formula (Ia). As for the copolymer, the copolymerizing component thereof may be constituted of the same or different ethylenic monomers which do not form any color because they cannot couple with the oxidation product of an aromatic primary amine developer, such as acrylic acid esters, methacrylic acid esters and maleic acid esters.

When the cyan coupler represented by general formula (Ia) is a monomer, $R_1$ preferably has from 1 to 30 carbon atoms and $R_2$, $R_3$ and $R_4$ each preferably has from 1 to 40 carbon atoms.

Specific examples of the cyan coupler of the present invention are illustrated below. However, the invention should not be construed as being limited to these examples.

(1)
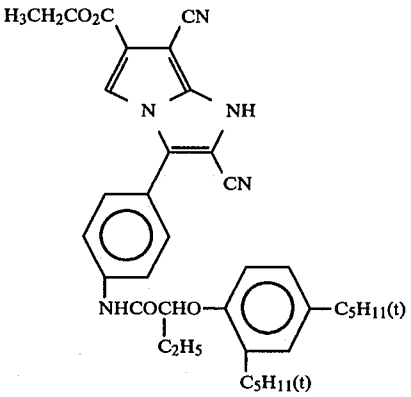
(2)
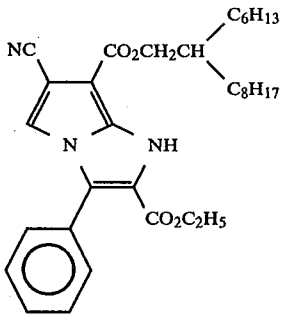

-continued
(3)
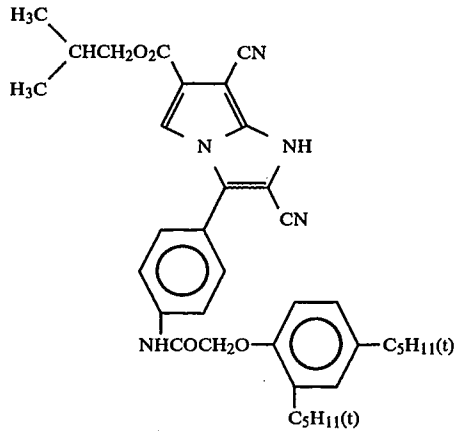
(4)
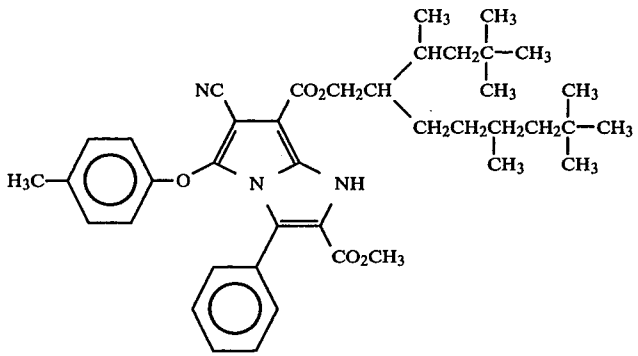

-continued
(5)
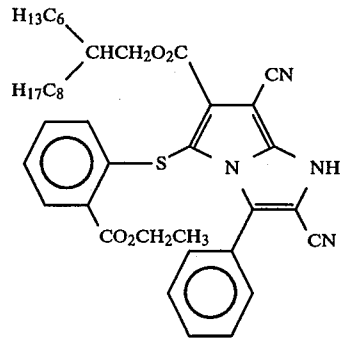
(6)
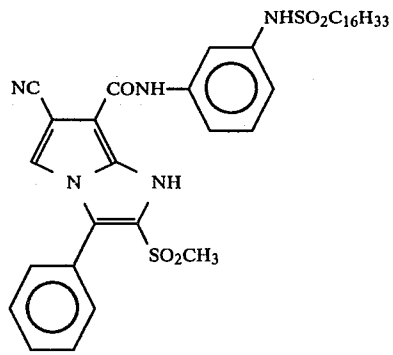
(7)
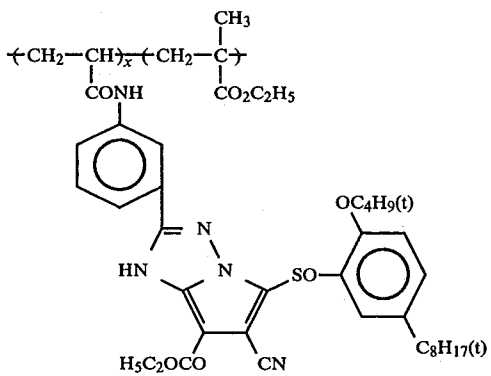
X:Y = 50:50 (molar ratio)

-continued
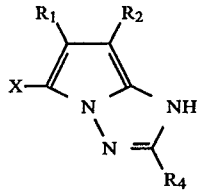
| No. | $R_1$ | $R_2$ | $R_4$ | X |
|---|---|---|---|---|
| 8 | $CO_2CH_3$ | CN | 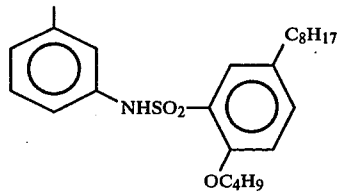 | H |
| 9 | CN | 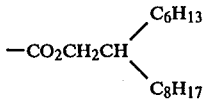 | 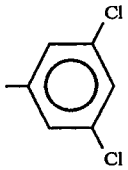 | H |
| 10 | CN | 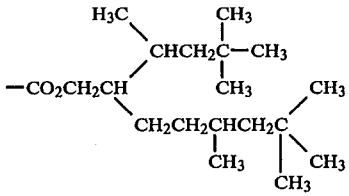 | 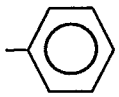 | H |
| 11 | CN | 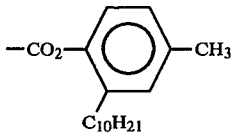 | 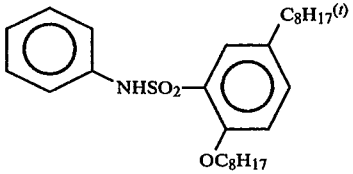 | H |

-continued
| | | | | |
|---|---|---|---|---|
| 12 | CN | 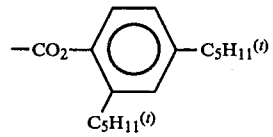 | 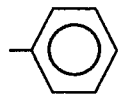 | H |
| 13 | CN | 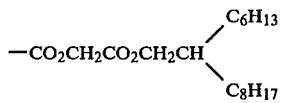 | 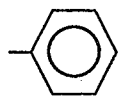 | H |
| 14 | CN | $-CO_2CH_2CH_2(CF_2)_6F$ | 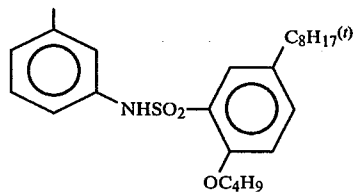 | H |
| 15 | CN | 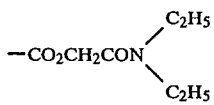 | 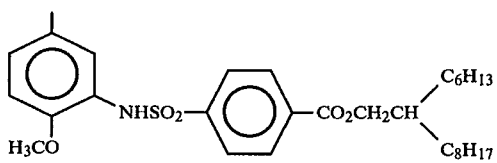 | 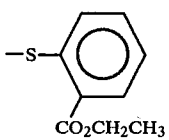 |
| 16 | CN | $-CO_2CH_2CH_2(CF_2)_6F$ | 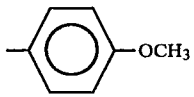 | 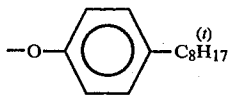 |
| 17 | CN | 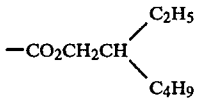 | 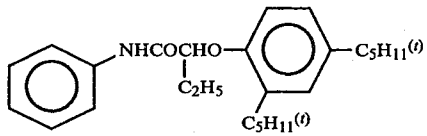 | 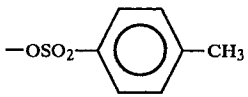 |

-continued
| | | | | |
|---|---|---|---|---|
| 18 | CN | 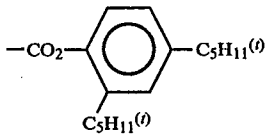 | 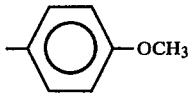 | 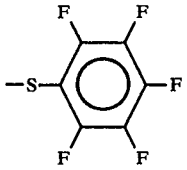 |
| 19 | CN | 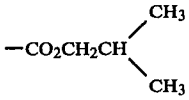 | 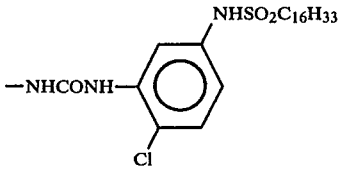 | 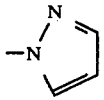 |
| 20 | CN | $-CO_2CH_2(CF_2)_4H$ | 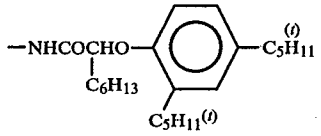 | 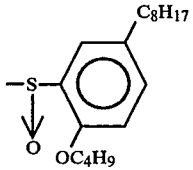 |
| 21 | CN | 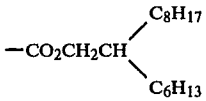 | 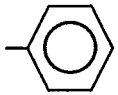 | H |
| 22 | 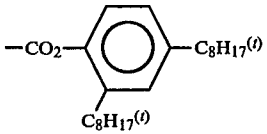 | CN | 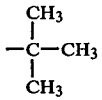 | 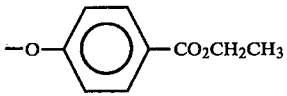 |
| 23 | $-CO_2CH_2C_6F_{13}$ | CN | 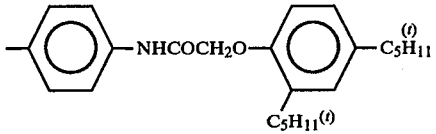 | Cl |

-continued
| | | | | |
|---|---|---|---|---|
| 24 | 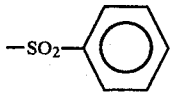 | 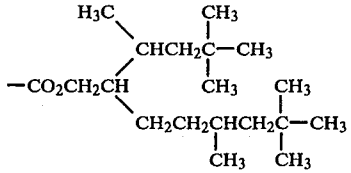 | $CH_3$ | $-OCOCH_3$ |
| 25 | CN | $-CO_2CH_2CO_2CH_3$ | 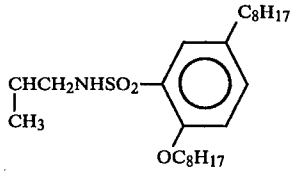 | 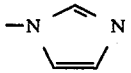 |
| 26 | CN | 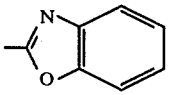 | 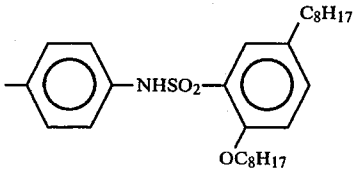 | 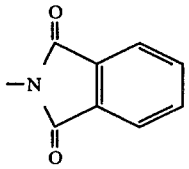 |
| 27 | CN | $CF_3$ | 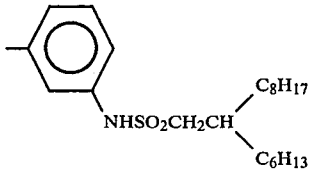 | $Cl^-$ |
| 28 | 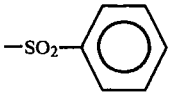 | $CF_3$ | 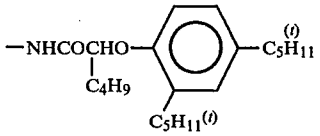 | F |
| 29 | CN | 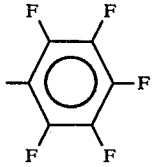 | 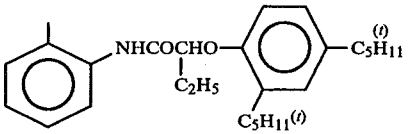 | 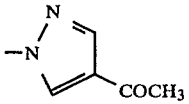 |

-continued
| | | | | |
|---|---|---|---|---|
| 30 | 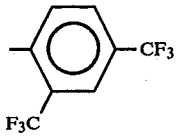 | $-SO_2Ph$ | 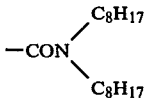 | 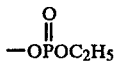 |
| 31 | CN | 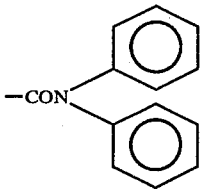 | 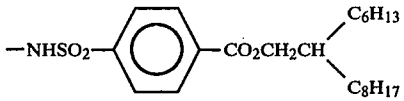 | 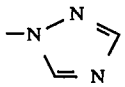 |
| 32 | CN | 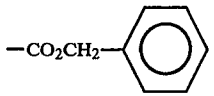 | 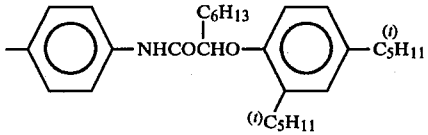 | H |
| 33 | CN | 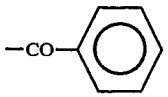 | 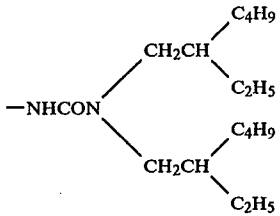 | $-OSO_2CH_3$ |
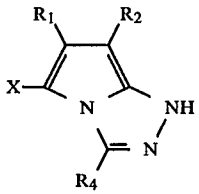
| No. | $R_1$ | $R_2$ | $R_4$ | X |
|---|---|---|---|---|

-continued
| | | | | |
|---|---|---|---|---|
| 34 | $-CO_2C_2H_5$ | CN | 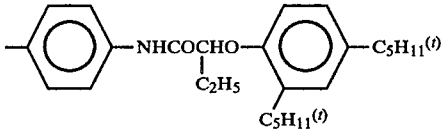 | Cl |
| 35 | CN | 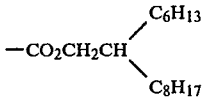 | 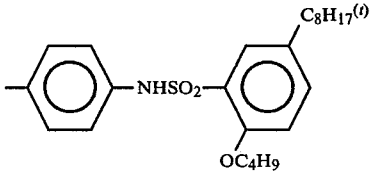 | H |
| 36 | CN | $-CO_2CH_2CH_2(CF_2)_6F$ | 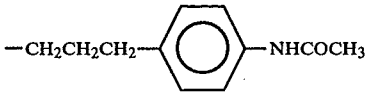 | 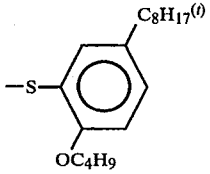 |
| 37 | CN | 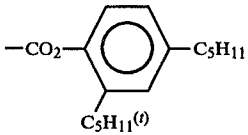 | 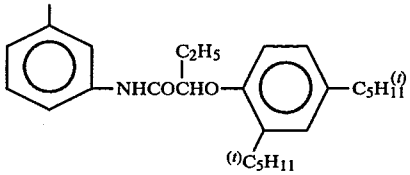 | 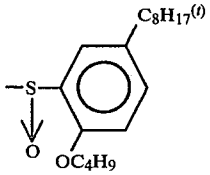 |
| 38 | CN | 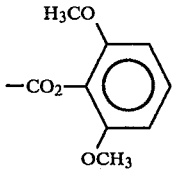 | 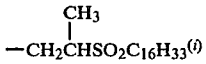 | 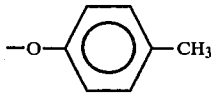 |
| 39 | CN | 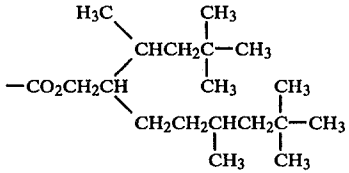 | 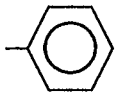 | H |

-continued
| | | | | |
|---|---|---|---|---|
| 39 | CN | 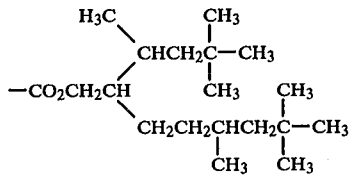 | 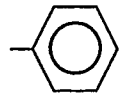 | H |
| 40 | CN | 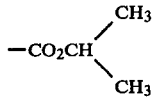 | 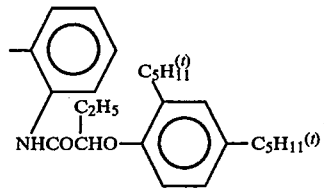 | Cl |
| 41 | CN | 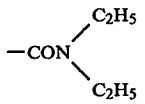 | 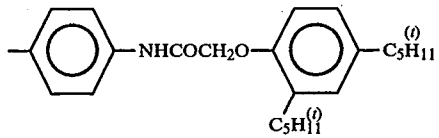 | $-OSO_2CH_3$ |
(42)
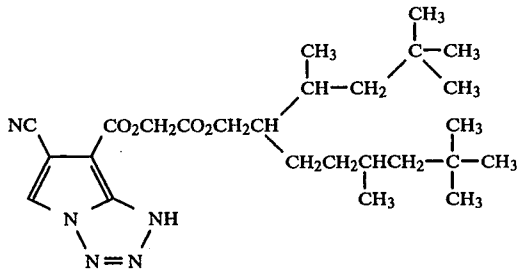
(43)
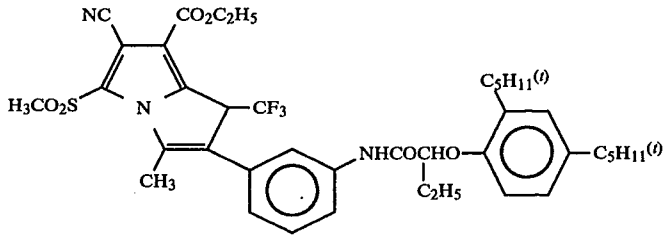

-continued
(44)
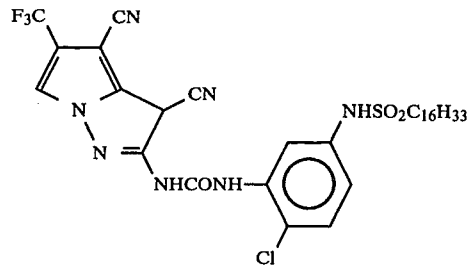
(45)
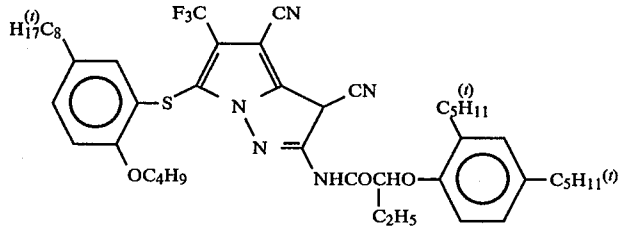
(46)
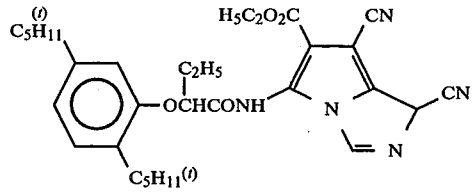
(47)
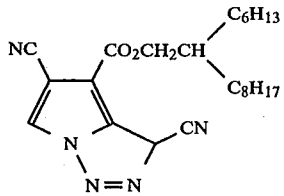

-continued
(48)
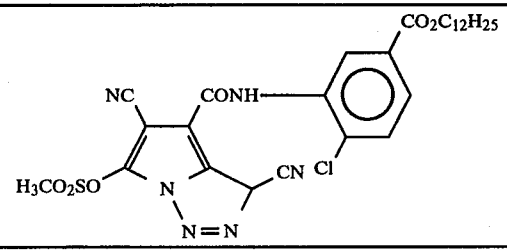

The present cyan couplers and intermediates thereof can be synthesized using known methods. Specifically, they can be synthesized according to the methods described, e.g., in *J. Am. Chem. Soc.*, 80, 5332 (1958), *J. Ame. Chem., vol.* 81, 2452 (1959), *J. Am. Chem. Soc.*, 112, 2465 (1990), *Oeg. Synth.*, 1270 (1941), *J. Chem. Soc.*, 5149 (1962), *Heterocyclic.*, vol. 27, 2301 (1988), *Rec. Trav. Chim.*, 80, 1075 (1961), and references cited therein; or methods analogous thereto.

The synthesis of the present cyan couplers is illustrated below with a concrete example.

Synthesis of Compound (9):

Compound (9) was synthesized in accordance with the following reaction scheme:

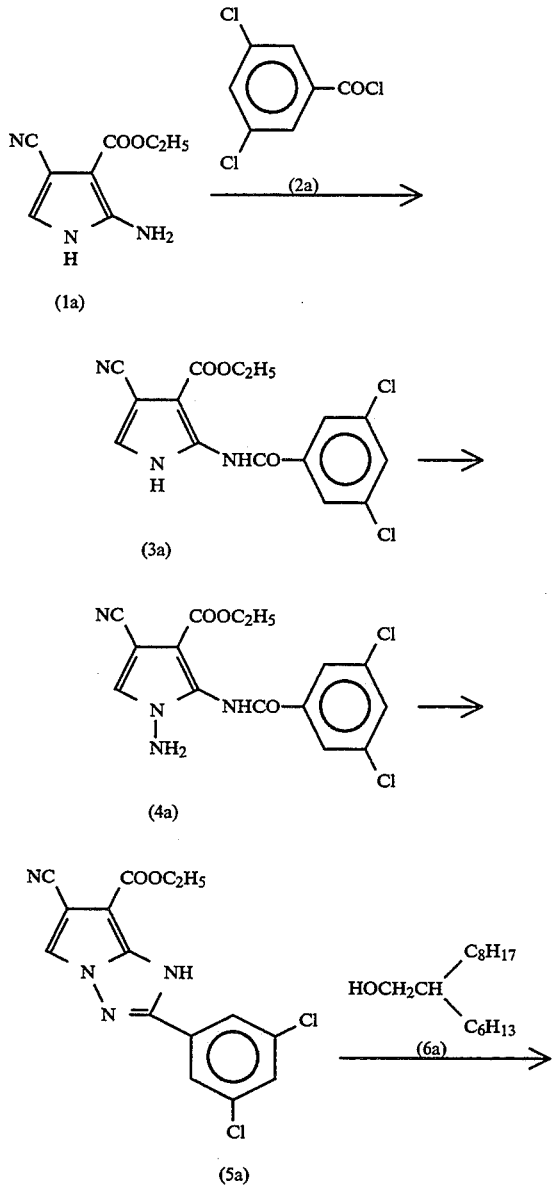

-continued

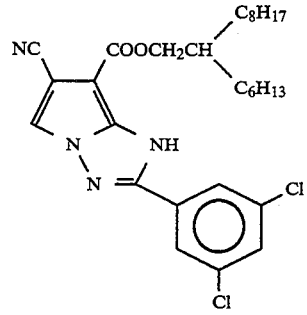

Compound (9)

To a solution containing 2-amino-4-cyano-3-methoxycarbonylpyrrole (1a) (66.0 g, 0.4 mol) in dimethylacetamide (300 ml) was added 3,5-dichlorobenzoyl chloride (2a) (83.2 g, 0.4 mol) at room temperature. The mixture was stirred for 30 minutes, and then admixed with water. The resulting solution was extracted in two steps with ethyl acetate. The organic layers were collected, washed successively with water and saturated brine, and dried over anhydrous sodium sulfate. The solvent was distilled away therefrom, and the residue was recrystallized from acetonitrile (300 ml). Thus, Compound (3a) (113 g, 84% yield) was obtained.

Potassium hydroxide powder (252 g, 4.5 mol) was added to a solution containing Compound (3a) (101.1 g, 0.3 mol) in dimethylformamide (200 ml) at room temperature, and stirred thoroughly. The resulting solution was cooled in an ice bath, and thereto was added hydroxylamine-o-sulfonic acid (237 g, 2.1 mol) in limited amounts with caution so as not to steeply raise the temperature of the reaction system. After the addition was completed, the reaction mixture was stirred for 30 minutes. Then, it was neutralized by dropping thereinto a 0.1N aqueous solution of hydrochloric acid as the pH thereof was checked with test paper. The neutralized matter was extracted in three steps with ethyl acetate. The organic layer was washed successively with water and saturated brine, and dried over anhydrous sodium sulfate. The solvent was distilled away under reduced pressure, and the residue was purified by column chromatography (developer: hexane/ethyl acetate=2/1). Thus, Compound (4a) (9.50 g, 9% yield) was obtained.

To a solution containing Compound (4a) (7.04 g, 20 mmol) in acetonitrile (30 ml), carbon tetrachloride (9 ml) first, and then triphenylphosphine (5.76 g, 22mmol) were added at room temperature. The resulting mixture was heated for 8 hours under reflux. After cooling, it was admixed with water, extracted in three steps with ethyl acetate. The organic layer was washed successively with water and saturated brine, and dried over anhydrous sodium sulfate. The solvent was distilled away under reduced pressure, and the residue was purified by silica gel column chromatography (developer: hexane/ethyl acetate=4/1). Thus, Compound (5a) (1.13 g, 17% yield) was obtained.

In 2.0 ml of sulforan were dissolved 1.8 g of Compound (5a) and 12.4 g of Compound (6a), and the solution was admixed with 1.5 g of titanium isopropoxide. The reaction was run for 1.5 hours as temperature was maintained at 110° C. Thereafter, the reaction mixture was admixed with ethyl acetate, and washed with water. The ethyl acetate layer was dried, and ethyl acetate was distilled away therefrom. The residue was purified by column chromatography. Thus, 1.6 g of the intended compound (9) was obtained. m.pt. 97°–98° C.

As for the yellow coupler, any of known couplers can be used in the present invention. In particular, the yellow couplers represented by the following general formula [Y] are preferable:

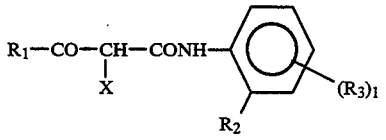

In the above formula, $R_1$ represents a tertiary alkyl group or an aryl group; $R_2$ represents a hydrogen atom, a halogen atom (including F, Cl, Br and I, also in the following illustration of formula [Y]), an alkoxy group, an aryloxy group, an alkyl group or a dialkylamino group; $R_3$ represents a group by which the hydrogen on a benzene ring can be replaced; X represents a hydrogen atom, or a group capable of splitting off by the coupling reaction with the oxidation product of an aromatic primary amine developer (abbreviated as a splitting-off group); l represents an integer of 0 to 4; and when l is no less than 2, $R_3$'s may be the same or different.

Examples of the group represented by $R_3$ include a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an arylsulfonyl group, a ureido group, a sulfamoylamino group, an alkoxycarbonylamino group, a nitro group, a heterocyclyl group, a cyano group, an acyl group, an acyloxy group, an alkylsulfonyloxy group and an arylsulfonyloxy group, and examples of the splitting-off group include a heterocyclyl group which is attached to the coupling active site via the nitrogen atom thereof, an aryloxy group, an arylthio group, an acyloxy group, an alkylsulfonyloxy group, a heterocyclyloxy group and a halogen atom. When $R_1$ represents a tertiary alkyl group, the group may include those having a cyclic structure, such as cyclopropyl, cyclobutyl, cyclopentyl, cyclohexyl or the like.

In general formula [Y], it is preferable that $R_1$ be t-butyl, 1-alkylcyclopropyl or 1-alkylcyclopentyl group, $R_2$ be a halogen atom, an alkyl group (including trifluoromethyl group), an alkoxy group or a phenoxy group, $R_3$ be a halogen atom, an alkoxy group, an alkoxycarbonyl group, a carbonamido group, a sulfonamido group, a carbamoyl group, a sulfonyl group or sulfamoyl group (including acylsulfamoyl group), X be an aryloxy group or a 5- to 7-membered heterocyclyl group which is attached to the coupling active site via the nitrogen atom thereof and may further contain N, S, O or/and P as hetero atom(s), and l be an integer of 0 to 2.

When $R_1$ represents a 1-alkylcyclopropyl or 1-alkylcyclopentyl group in general formula [Y], it is desirable for the alkyl moiety to contain from 1 to 18 carbon atoms. Preferably, the alkyl moiety is a straight-chain alkyl group containing 1 to 18 carbon atoms, more preferably 1 to 4 carbon atoms, especially ethyl group.

The coupler represented by general formula [Y] may be a dimer or a polymer of higher order formed by combining mutually with its molecules at the position of $R_1$, X or

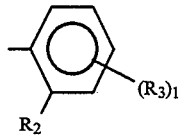

via a divalent group or a group of higher valency, or may be a homopolymer or a copolymer containing polymerizing units incapable of producing any color.

Specific examples of the coupler represented by general formula [Y] are illustrated below.

(Y-1)

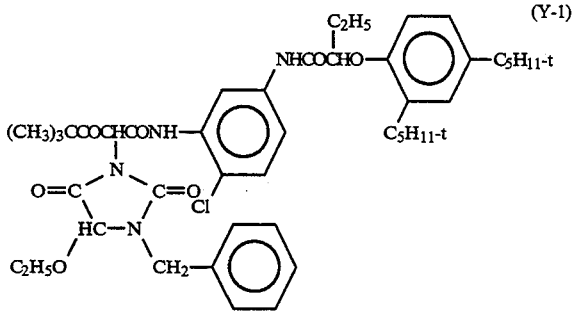

(Y-2)

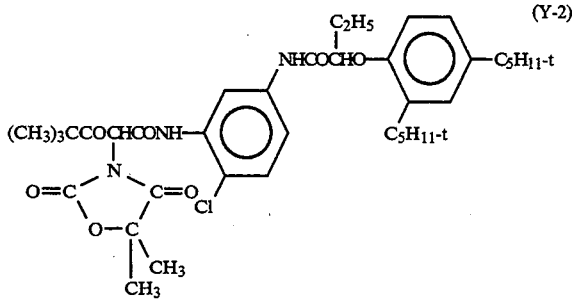

(Y-3)

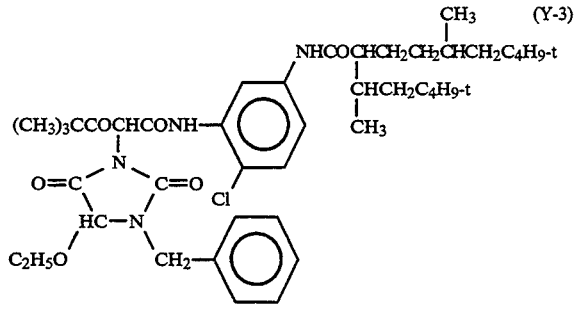

(Y-4)

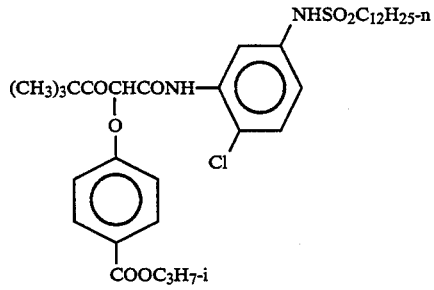

-continued
(Y-5)
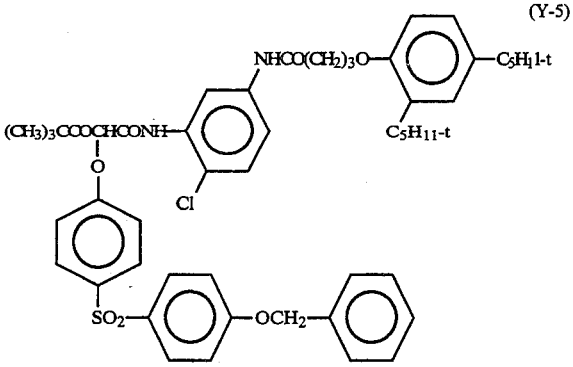
(Y-6)
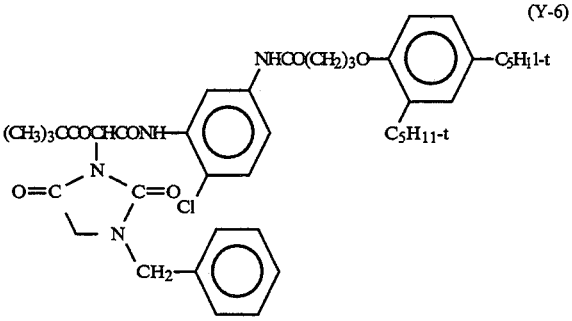
(Y-7)
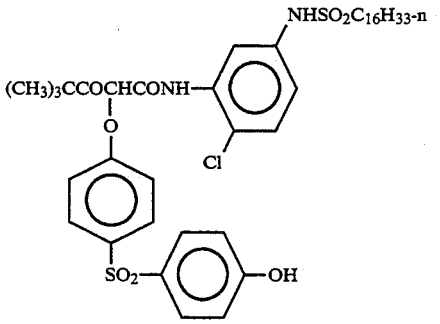
(Y-8)
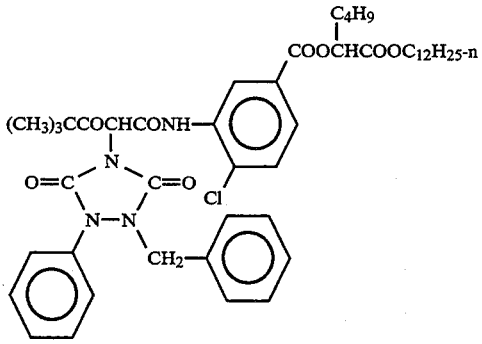
(Y-9)
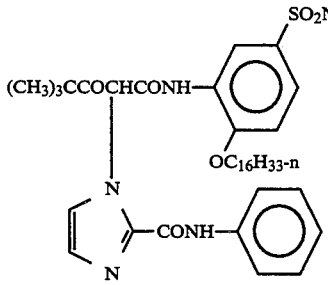
-continued
(Y-10)
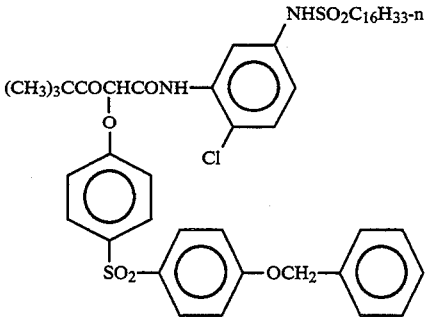
(Y-11)
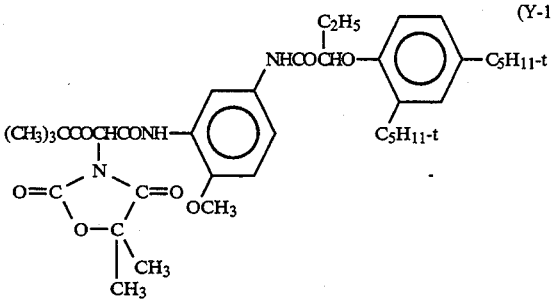
(Y-12)
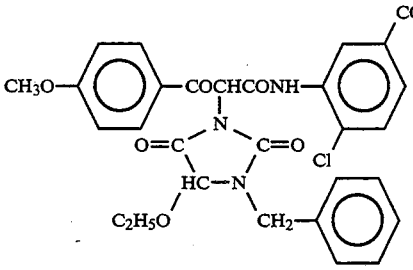
(Y-13)
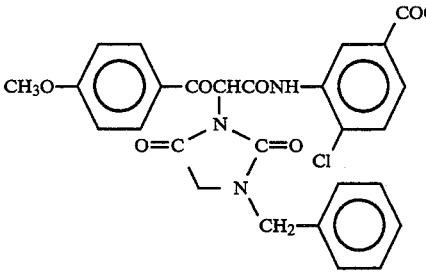
(Y-14)
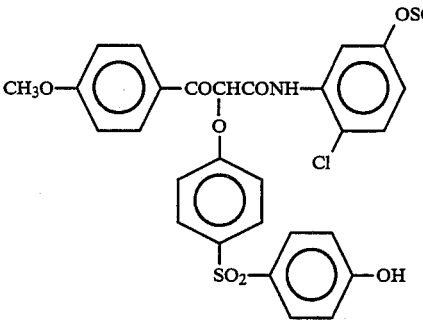

-continued

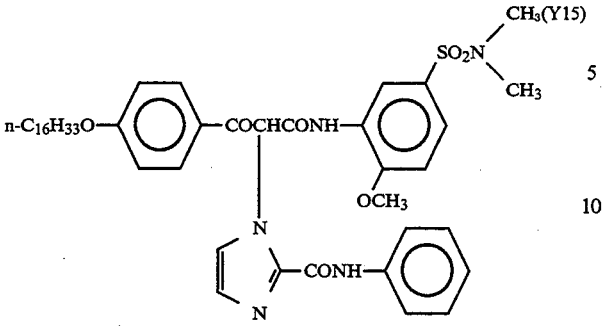

(Y15)

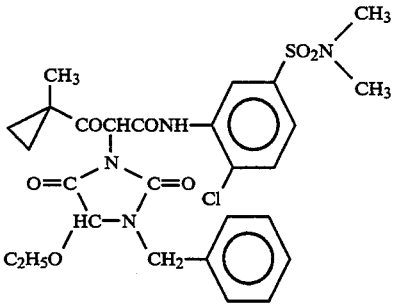

(Y-16)

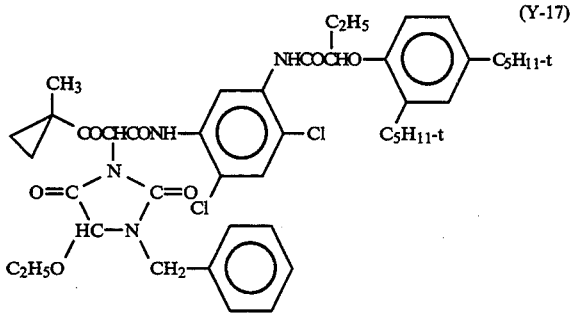

(Y-17)

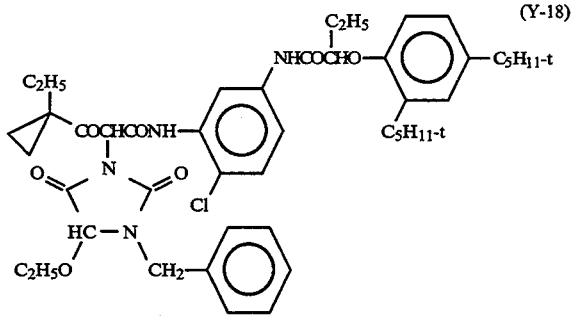

(Y-18)

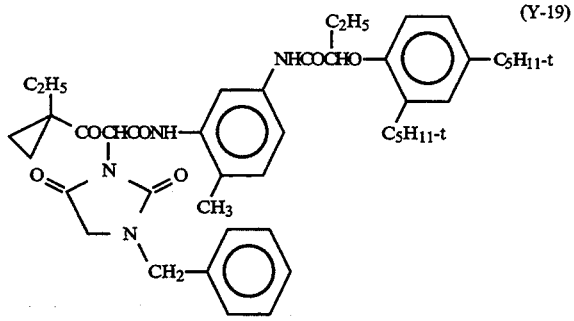

(Y-19)

-continued

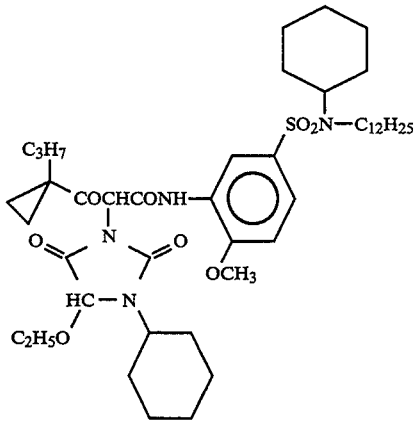

(Y-20)

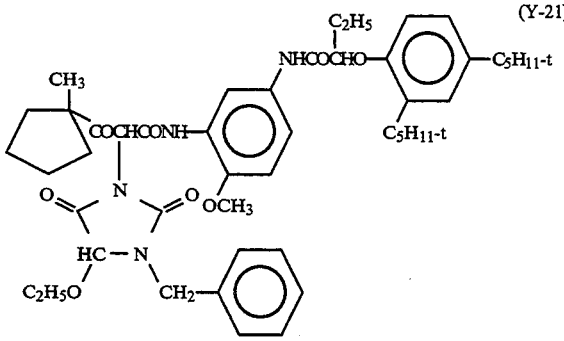

(Y-21)

Yellow couplers which can be used in the present invention, other than the foregoing ones, and/or synthesis methods for these yellow couplers are disclosed, e.g., in U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837 and 4,729,944, EP 0 030 747 A, EP 0 284 081 A, EP 0 296 793 A, EP 0 313 308 A, West German Patent C 3,107,173, JP-A-58-43044, JP-A-59-174839, JP-A-62-276547 and JP-A-63-123047.

Magenta couplers which can be used in the present invention include 5-pyrazolone type magenta couplers and pyrazoloazole type magenta couplers as described in EP 0 355 660 A2. Of these couplers, particularly, a pyrazolotriazole coupler in which a secondary or tertiary alkyl group is directly bonded to the pyrazolotriazole ring at the 2-, 3- or 6-position as described in JP-A-61-65245, a pyrazoloazole coupler containing a sulfonamide group in the molecule as described in JP-A-61-65246, a pyrazoloazole coupler having an alkoxyphenyl sulfonamide group as a ballast group as described in JP-A-61-147254, a and pyrazoloazole coupler having an alkoxy or aryloxy group at the 6-position as described in EP 0 226 849 A and EP 0 294 785 A are preferred from the standpoint of hue, image stability, and color forming property.

Standard amounts of three kinds of color couplers used in the present invention are each in the range of 0.001 to 1 mole per mole of silver halide. Preferably, the amount ranges from 0.01 to 0.5 mole with respect to the yellow coupler, from 0.003 to 0.5 mole with respect to the magenta coupler, and from 0.002 to 0.5 mole with respect to the cyan coupler.

The present cyan couplers of general formula (Ia) and other couplers can be incorporated into a photosensitive material by known dispersion methods. Usually, couplers can be added using an oil-in-water dispersion method known as oil protect method. More specifically, the oil-in water dispersion can be formed by dissolving a color coupler in a solvent, and then dispersing the solution into a surfactant-containing aqueous gelatin solution in an emulsified condition; or by adding water or an aqueous gelatin solution to a surfactant-containing aqueous coupler solution, and thereby causing phase inversion in the resulting solution.

Photographic additives which can be used in the present invention, including cyan, magenta and yellow couplers, are preferably dissolved in a high boiling organic solvent. Such a high boiling organic solvent is a water-immiscible compound having a melting point of 100° C. or lower and a boiling point of 140° C. or higher and is a good solvent for the couplers. The melting point of preferable high boiling organic solvents is 80° C. or lower and the boiling point thereof is 160° C. or higher, more preferably 170° C. or higher.

Details of such high boiling organic solvents are described in JP-A-62-215272, from the right lower column at page 137 to the right upper column at page 144.

As the high boiling organic solvent used for dissolving a dispersed emulsion of the cyan coupler of the present invention, those having a dielectric constant of at least 4.2 are particularly preferred from the standpoint of not reducing the yellow color-developing density, etc. The upper limit of the dielectric constant is preferably 20. The dielectric constant of the high boiling organic solvents is more preferably 5 to 20.

On the other hand, a loadable latex polymer (as disclosed, e.g., in U.S. Pat. No. 4,203,716) impregnated with a cyan, magenta or yellow coupler in the presence or absence of a high boiling organic solvent as described above, or such a coupler dissolved in a high boiling organic solvent together with a polymer insoluble in water but soluble in an organic solvent, can be dispersed into a hydrophilic colloid solution in an emulsified condition.

Polymers which can be preferably used therein include the homo- or copolymers disclosed in U.S. Pat. No. 4,857,449, from column 7 to column 15, and WO 88/00723, from page 12 to page 30. More preferably, polymers of methacrylate or acrylamide type, particularly those of acrylamide type, are favored over others with respect to color image stabilization and so on.

The color photographic material of the present invention can be constructed by providing on a support at least one blue-sensitive silver halide emulsion layer, at least one green-sensitive silver halide emulsion layer and at least one red-sensitive silver halide emulsion layer. Therein, colors are reproduced in accordance with the subtractive color process by incorporating into each of those sensitive emulsion layers the combination of a silver halide emulsion having sensitivity in its individual wavelength region and a so-called color coupler which can form a dye bearing a complementary color relationship to the colored light by which the emulsion is sensitized, that is, a yellow dye to blue light, a magenta dye to green light and a cyan dye to red light. However, the photographic material of the present invention may be designed so as not to have the above-described correspondence of each light-sensitive layer to the developed hue of the coupler incorporated therein. Additionally, at least one of the foregoing emulsion layers can be replaced by an infrared-sensitive silver halide emulsion layer.

The arranging order of emulsion layers on the support can be arbitrarily chosen as long as the cyan coupler-containing silver halide emulsion layer is arranged at the position nearer to the support than at least either the magenta coupler-containing silver halide emulsion layer or the yellow coupler-containing silver halide emulsion layer. More specifically, in case each layer contains a coupler capable of forming a dye which bears the complementary color relationship to the light by which the emulsion layer is sensitized, the order in which silver halide emulsion layers are provided is: beginning with the nearest to the support, a blue-sensitive silver halide emulsion layer, a red-sensitive silver halide emulsion layer and a green-sensitive silver halide emulsion layer; a red-sensitive silver halide emulsion layer, a green-sensitive silver halide emulsion layer and a blue-sensitive emulsion layer; or so on.

Light-sensitive silver halides which can be used in the silver halide emulsions of the present invention are silver chloride, silver bromide, silver chlorobromide, silver iodobromide, silver chloroiodobromide, silver iodochloride and so on. For sensitive materials to have a rapid processing ability, it is desirable to use silver chloride or silver chlorobromide having a chloride content of at least 90 mole % (preferably at least 98 mole %), which is substantially free from silver iodide.

As for the support of the present photographic material, there can be used those for general photographic materials, including transparent films such as a cellulose triacetate film, a polyethylene terephthalate film, etc., and reflective supports such as baryta paper, polyethylene-laminated paper, a transparent support provided with a reflective layer or used with a reflective material, etc.

In addition to the above-cited transparent films, a support of the white polyester type or a support provided with a white pigment-containing layer on the same side as the silver halide emulsion layers may be adopted for display use. In the case of the foregoing support, it is desired that the transmission density of the support be adjusted to the range of 0.35 to 0.8 so that a display may be enjoyed by means of both transmitted and reflected light. Further, sharpness may be improved by providing an antihalation layer on the emulsion layer side or the reverse side of the support.

To enhance image sharpness and the like, it is desirable (i) that dyes capable of undergoing decolorization by photographic processing (especially oxonol dyes), which are disclosed at pages 27–76 in EP 0 337 490 A2, be added to a hydrophilic colloid layer of the present photographic material in such an amount as to impart an optical reflection density of at least 0.70 at 680 nm to the resulting photographic material, and (ii) that titanium oxide grains which have undergone surface treatment with a di- to tetrahydric alcohol (e.g., trimethylolethane) be incorporated in a content of at least 12 wt % (preferably at least 14 wt %) into a waterproof resin coat of the support.

Furthermore, it is desirable for improving the stability of color images that compounds as disclosed in EP 0 277 589 A2 be used together with couplers in the photographic material of the present invention. In particular, it is preferable that such compounds be used in combination with couplers of pyrazoloazole type and the inventive cyan couplers of pyrroloazole type represented by general formula (Ia).

Compounds of the kind which can produce chemically inert, substantially colorless compounds by combining chemically with an aromatic amine developing agent remaining after the color development-processing (Compound F) and/or compounds of the kind which can produce chemically inert, substantially colorless compounds by combining chemically with the oxidized aromatic amine developing agent remaining after the color development-processing (Compound G) are preferably used in combination or independently. By the use of these compounds, the generation of stains due to the formation of dyes through the reaction between the couplers and the unoxidized or oxidized color developing agent remaining in the processed photographic film, and the occurrence of other side reactions upon storage after photographic processing, can be inhibited effectively.

Also, it is desirable that the antimold compounds disclosed in JP-A-63-271247 be added to the photographic material of the present invention in order to prevent the deterioration of images from occurring through propagation of various kinds of molds and bacteria in hydrophilic colloid layers.

The photographic material of the present invention may be exposed to either visible or infrared rays. For the exposure, not only low intensity exposure but also high intensity short-time exposure may be employed. In the latter case, a laser scanning exposure system in which the exposure time per picture element is shorter than $10^{-4}$ second is preferred in particular.

Upon exposure, it is preferable to use the band stop filter disclosed in U.S. Pat. No. 4,880,726. This filter can get rid of color stain of optical origin to improve color reproducibility to a great extent.

After exposure, it is desirable that the color photographic material of the present invention be subjected to development, bleach-fix and washing (or stabilization) operations. However, bleach and fixation steps may not be carried out with a monobath, but they may be carried out separately.

As for the silver halide emulsions and other ingredients (such as additives, etc.) and the photographic constituent layers (including their order of arrangement), those disclosed in the following patent specifications, especially EP 0 355 660 A2 (corresponding to JP-A-2-139544) can be preferably applied to the photographic material of the present invention.

| Photographic Element | JP-A 62-215272 | JP-A 2-33144 | EP 0 355 660 A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from below to page 18, left lower column, last line | | |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color, Coupler, (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 28, last line; page 45, lines 29 to 31; and from page 47, line 23 to page 63, line 50 |
| Coloring Enhancers | From page 121, left lower column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-Fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines I to 51 |
| Dispersing Methods of Photographic Additives | From page 144, left lower column, line 1 to page 146, | From page 27, right lower column, line 10 to page 28, | From page 63, line 51 to page 64, line 56 |

-continued

| Photographic Element | JP-A 62-215272 | JP-A 2-33144 | EP 0 355 660 A2 |
|---|---|---|---|
| | right upper column, line 7 | left upper column, last line; and from page 35, right lower column, line 12, to page 36, right upper column, line 7 | |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 3 6, right upper column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-Containing Compounds (as antistatic agents, coating aids, lubricants, and anti-blocking agents) | From page 210, left lower column, line 1 to page 222, left lower column, line 5 | From page 25, left upper column, line 1 to page 27, right upper column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |

As for the yellow couplers, the so-called short wave type couplers disclosed in JP-A-63-231451, JP-A-63-123047, JP-A-63-241547, JP-A-1-173499, JP-A-1-213648 and JP-A-1-250944 are preferably used in addition to those cited in the above references.

As for the cyan couplers which may be used together with the present cyan couplers of general formula (Ia), diphenylimidazole type cyan couplers disclosed in JP-A-2-33144, 3-hydroxypyridine type cyan couplers disclosed in EP 0 333 185 A2 (especially one which is prepared by introducing a chlorine atom as a splitting-off group into Coupler (42) cited as a specific example to render the coupler two-equivalent, and Couplers (6) and (9) cited as specific examples), cyclic active methylene type cyan couplers disclosed in JP-A-64-32260 (especially Couplers 3, 8 and 34 cited as specific examples) and so on are additional examples thereof. When the present cyan couplers are used as a mixture with other cyan couplers, it is desirable that the present cyan couplers be present in the mixture in a proportion of at least 30 mole %, preferably at least 60 mole %.

The present invention will now be described in detail by way of the following examples.

EXAMPLE 1

The surface of a paper support laminated with polyethylene on both sides was subjected to a corona discharge operation, provided with a gelatin undercoat containing sodium dodecylbenzenesulfonate, and further coated with various photographic constituent layers to prepare a multilayer color photographic paper having the following layer structure (Sample No. 101). Coating compositions used were prepared in the manner described below.

Preparation of Coating Solution for Fifth Layer;

A cyan coupler (ExC) in the amount of 80.0 g, 43.6 g of an ultraviolet absorbent (UV-2), 80.0 g of a color image stabilizer (Cpd-1), 2.4 g of a color image stabilizer (Cpd-6), 2.4 g of a color image stabilizer (Cpd-8), 36.4 g of a color image stabilizer (Cpd-9), 36.4 g of a color image stabilizer (Cpd-10), 2.4 g of a color image stabilizer (Cpd-11) and 140.6 g of a solvent (Solv-6) were dissolved in a mixed solvent consisting of 14.5 ml of a solvent (Solv-1) and 180.0 ml of ethyl acetate, and then dispersed in an emulsified condition into 1,000 g of a 10% aqueous gelatin solution containing 60 ml of a 10% solution of sodium dodecylbenzenesulfonate to prepare an emulsified Dispersion C. On the other hand, two kinds of silver chlorobromide emulsions [both of which had a cubic crystal form; one of which had an average grain size of 0.50 μm and a variation coefficient of 0.09 with respect to the grain size distribution (large-sized Emulsion C1), and the other of which had an average grain size of 0.41 μm and a variation coefficient of 0.11 with respect to the grain size distribution (small-sized Emulsion C2); both of which had a bromide content of 0.8 mol %, the bromide being localized in part of each grain] were prepared. Further, a red-sensitive dye E was added to the large-sized Emulsion C1 and the small-sized Emulsion C2 in the amounts of $0.9\times10^{-4}$ mole and $1.1\times10^{-4}$ mole, respectively, per mole of silver. These emulsions C1 and C2 were mixed in a ratio of 1:4 by mole on a silver basis to obtain a silver chlorobromide Emulsion C. Furthermore, Compound F was added to Emulsion C in the amount of $2.6\times10^{-3}$ mole per mole of silver. After the resulting Emulsion C was chemically sensitized with a sulfur sensitizer and a gold sensitizer to an optimum extent, it was mixed homogeneously with the foregoing emulsified Dispersion C. Thereto were added other ingredients described below so as to obtain the coating solution for the fifth layer having the following composition.

Coating solutions for other layers were prepared respectively in the same manner as that for the fifth layer. In each layer, sodium salt of 1-oxy-3,5-dichloro-s-triazine was used as gelatin hardener.

In addition, Cpd-14 and Cpd-15 were added to all layers so that their coverages were 25.0 mg/m$^2$ and 50.0 mg/m$^2$, respectively.

Spectral sensitizing dyes illustrated below were added to the silver chlorobromide emulsions for each light-sensitive emulsion layer.

Blue-sensitive Emulsion Layer

Sensitizing Dye A

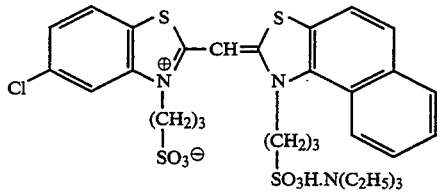

Sensitizing Dye B

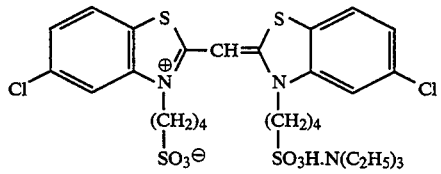

(Sensitizing Dyes A and B illustrated above were added to the large-sized emulsion in the same amount of $2.0\times10^{-4}$ mole per mole silver, and to the small-sized emulsion in the same amount of $2.5\times10^{-4}$ mole per mole of silver.)

Green-sensitive Emulsion Layer

Sensitizing Dye C

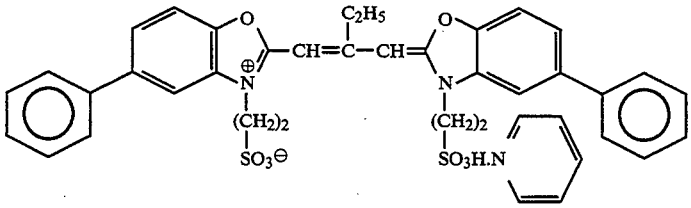

(Sensitizing Dye C illustrated above was added to the large-sized emulsion in the amount of $4.0\times10^{-4}$ mole per mole silver, and to the small-sized emulsion in the amount of $5.6\times10^{-4}$ mole per mole of silver.)

Sensitizing Dye D

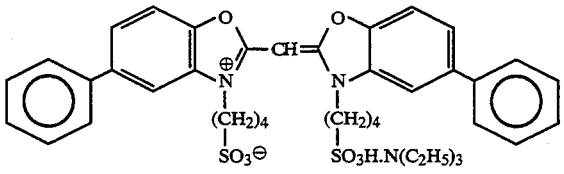

(Sensitizing Dye D illustrated above was added to the large-sized emulsion in the amount of $7.0\times10^{-5}$ mole per mole silver, and to the small-sized emulsion in the amount of $1.0\times10^{-5}$ mole per mole of silver.)

Red-sensitive Emulsion Layer

Sensitizing Dye E

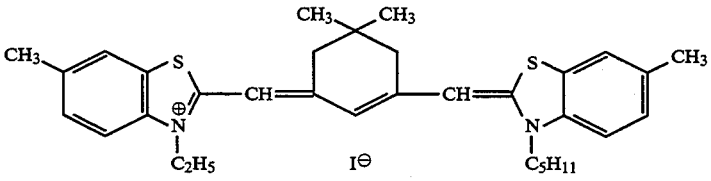

(Sensitizing Dye E was added to the large-sized emulsion in the amount of $0.9\times10^{-4}$ mole per mole silver, and to the small-sized emulsion in the amount of $1.1\times10^{-4}$ mole per mole silver.)

Further the following compound was added in the amount of $2.6\times10^{-3}$ mole per mole of silver halide:

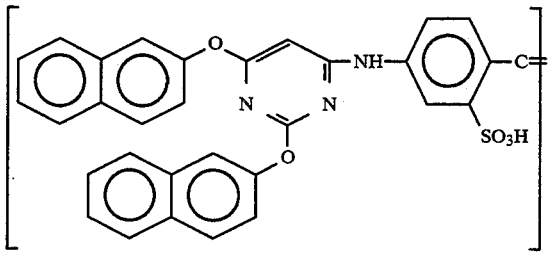

Moreover, 1-(5-methylureidophenyl)-5-mercaptotetrazole was added to the blue-sensitive emulsion layer, the green-sensitive emulsion layer and the red-sensitive emulsion layer in the amounts of $8.5\times10^{-4}$ mole, $7.7\times10^{-4}$ mole and $2.5\times10^{-4}$ mole, respectively, per mole of silver halide.

Furthermore, 4-hydroxy-6-methyl-1,3,3a,7-tetraazaindene was added to the blue-sensitive emulsion layer and the green-sensitive emulsion layer in the amounts of $1\times10^{-4}$ mole and $2\times10^{-4}$ mole, respectively, per mole of silver halide.

In addition, the dyes illustrated below (their respective coverages are designated in parentheses) were added to each emulsion layer in order to inhibit an irradiation phenomenon from occurring.

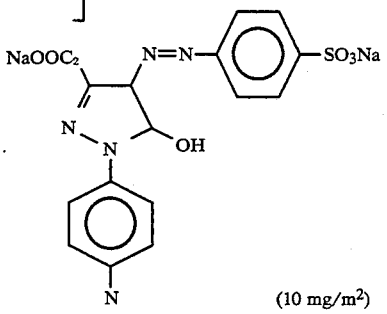

(10 mg/m²)

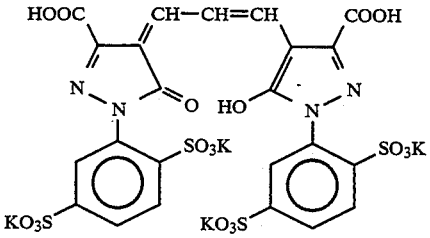

(10 mg/m²)

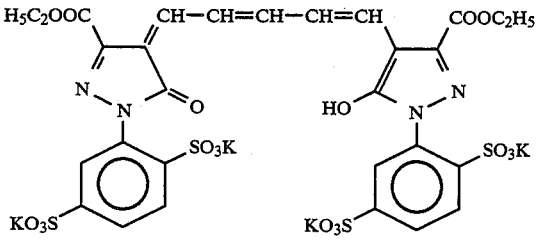

(40 mg/m²)

and

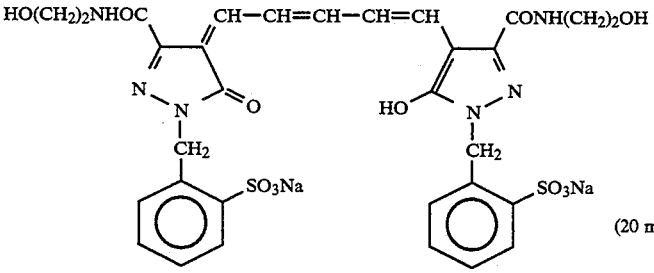

(20 mg/m²)

The composition of each constituent layer is described below. Each figure on the right side designates the coverage (g/m²) of the ingredient corresponding thereto. As for the silver halide emulsion, the figure represents the coverage based on silver.

Support:

Polyethylene-laminated paper which contained white pigment ($TiO_2$) and a bluish dye (ultramarine) in the polyethylene laminate on the side of the first layer -continued

| | |
|---|---|
| First layer (blue-sensitive emulsion layer): | |
| Silver chlorobromide emulsion (having a cubic crystal form, and being a 3:7 mixture of a large-sized Emulsion A1 having an average grain size of 0.88 μm and a variation coefficient of 0.08 with respect to grain size distribution and a small-sized Emulsion A2 having an average grain size of 0.70 μm and a variation coefficient of 0.10 with respect to grain size distribution, which each contained 0.3 mol % of AgBr localized in part of the grain) | 0.27 |
| Gelatin | 1.36 |
| Yellow coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| Second layer (color stain inhibiting layer): | |
| Gelatin | 1.00 |
| Color stain inhibitor (Cpd-4) | 0.06 |
| Solvent (Solv-7) | 0.03 |
| Solvent (Solv-2) | 0.25 |
| Solvent (Solv-3) | 0.25 |
| Third layer (green-sensitive emulsion layer): | |
| Silver chlorobromide emulsion (having a cubic crystal form, and being a 1:3 mixture of a large-sized Emulsion B1 having an average grain size of 0.55 μm and a variation coefficient of 0.10 with respect to grain size distribution with a small-sized Emulsion B2 having an average grain size of 0.39 μm and a variation coefficient of 0.08 with respect to grain size distribution, which each contained 0.8 mol % of AgBr localized in part of the grain) | 0.13 |
| Gelatin | 1.45 |
| Magenta coupler (ExM) | 0.16 |
| Color image stabilizer (Cpd-5) | 0.15 |
| Color image stabilizer (Cpd-2) | 0.03 |
| Color image stabilizer (Cpd-6) | 0.01 |

-continued

| | |
|---|---|
| Color image stabilizer (Cpd-7) | 0.01 |
| Color image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (color stain inhibiting layer): | |
| Gelatin | 0.70 |
| Color stain inhibitor (Cpd-4) | 0.04 |
| Solvent (Solv-7) | 0.02 |
| Solvent (Solv-2) | 0.18 |
| Solvent (Solv-3) | 0.18 |
| Fifth layer (red-sensitive emulsion layer): | |
| The foregoing silver chlorobromide Emulsion C | 0.20 |
| Gelatin | 1.60 |
| Cyan coupler (ExC) | 0.33 |
| Ultraviolet absorbent (UV-2) | 0.18 |
| Color image stabilizer (Cpd-9) | 0.01 |
| Color image stabilizer (Cpd-10) | 0.01 |
| Color image stabilizer (Cpd-11) | 0.01 |
| Solvent (Solv-6) | 0.58 |
| Color image stabilizer (Cpd-8) | 0.01 |
| Color image stabilizer (Cpd-6) | 0.01 |
| Solvent (Solv-1) | 0.06 |
| Color image stabilizer (Cpd-1) | 0.33 |
| Sixth layer (ultraviolet absorbing layer): | |
| Gelatin | 0.55 |
| Ultraviolet absorbent (UV-1) | 0.35 |
| Color image stabilizer (Cpd-12) | 0.15 |
| Color image stabilizer (Cpd-5) | 0.02 |
| Seventh layer (protective layer): | |
| Gelatin | 1.13 |
| Acryl-modified polyvinyl alcohol (modification degree: 17%) | 0.05 |
| Liquid paraffin | 0.02 |
| Color image stabilizer (Cpd-13) | 0.01 |

The structural formulae of the compounds used herein are illustrated below:

(ExY) Yellow Coupler

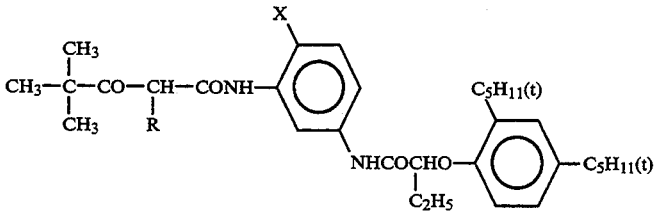

1:1 (by mole) mixture of that containing

R = 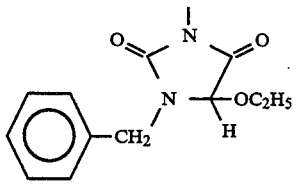 and X = Cl with that containing R = 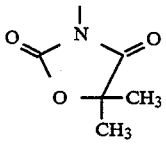 and X = $OCH_3$ (ExM) Magenta Coupler

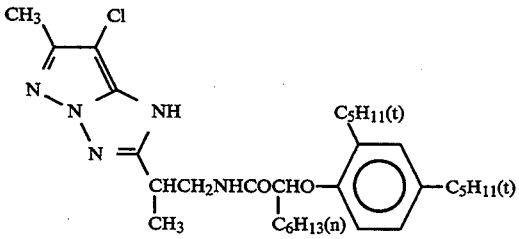

(ExC) Cyan Coupler

3:7 (by mole) mixture of

-continued
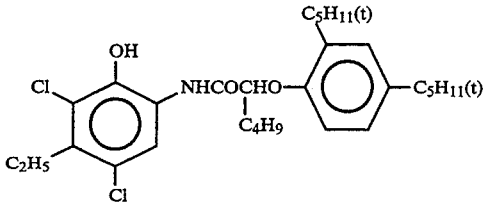
and
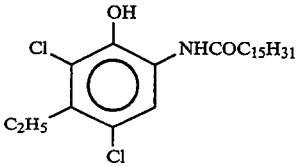
(Cpd-1) Color Image Stabilizer
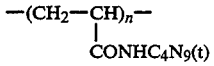
(Average molecular weight: 60,000)
(Cpd-2) Color Image Stabilizer
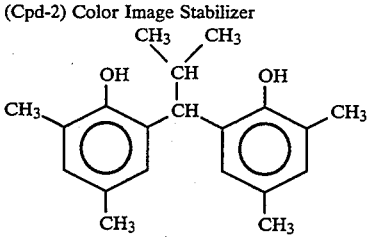
(Cpd-3) Color Image Stabilizer
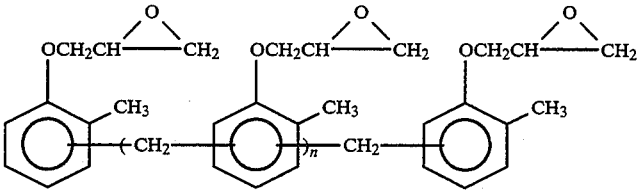
n = 7–8 (on average)
(Cpd-4) Color stain inhibitor
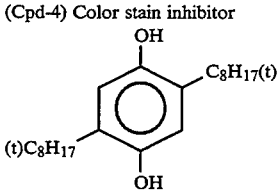
(Cpd-5) Color image stabilizer
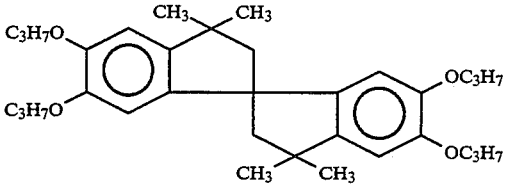
(Cpd-6) Color Image Stabilizer
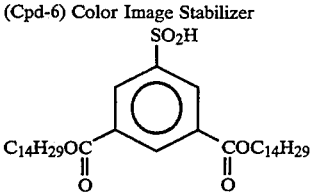
(Cpd-7) Color image stabilizer
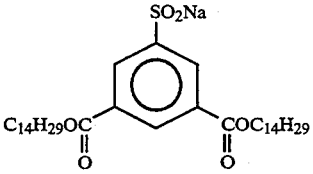
(Cpd-8) Color image stabilizer -continued
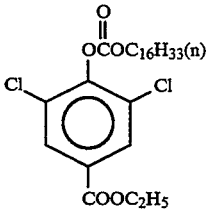
(Cpd-9) Color Image Stabilizer
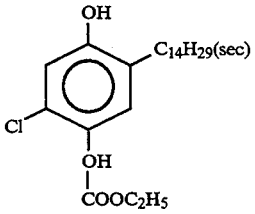
(Cpd-10) Color Image Stabilizer
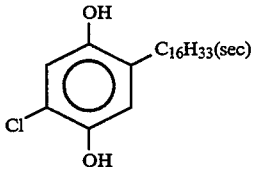
(Cpd-11) Color image stabilizer
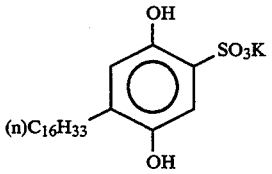
(Cpd-12) Color image stabilizer
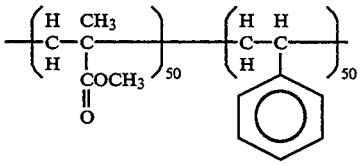
average molecular weight: 60,000
(Cpd-13) Color image stabilizer
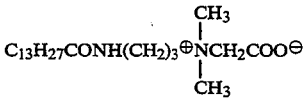
(Cpd-14) Antiseptic
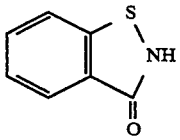
(Cpd-15) Antiseptic
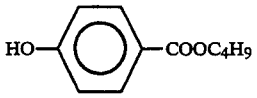
(UV-1) Ultraviolet Absorbent
1:5:10:5 (by weight) Mixture of (1), (2), (3) and (4):

-continued
(1)
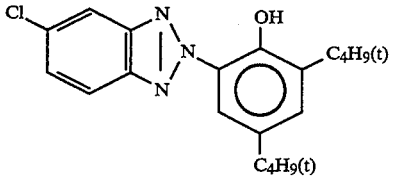
(2)
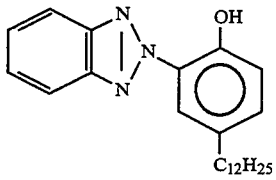
(3)
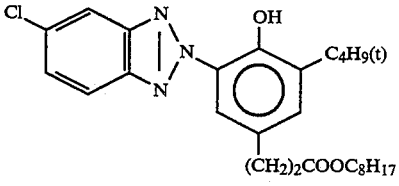
(4)
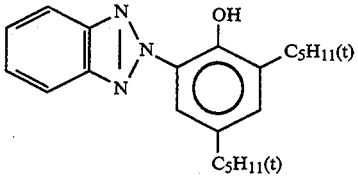
(UV-2) Ultraviolet absorbent
1:2:2 (by weight) Mixture of (1), (2) and (3):
(1)
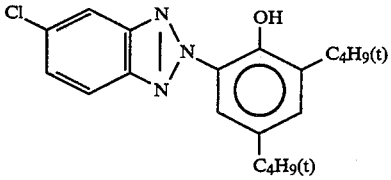
(2)
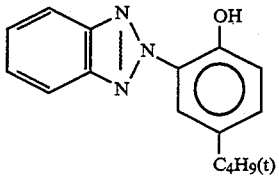
(3)
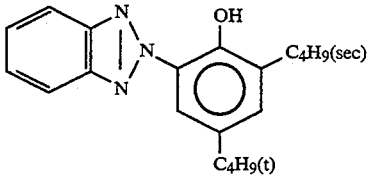
(Solv-1) Solvent
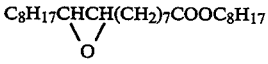
(Solv-2) Solvent
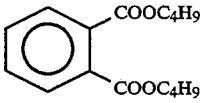
(Solv-3) Solvent
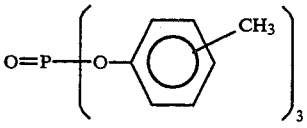
(Solv-4) Solvent
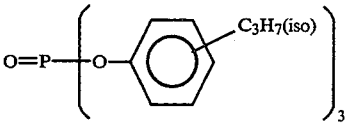
(Solv-5) Solvent
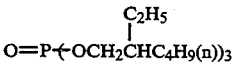
(Solv-6) Solvent -continued

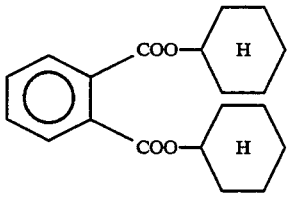

(Solv-7) Solvent

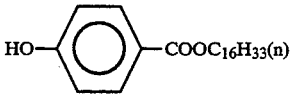

(Solv-8) Solvent

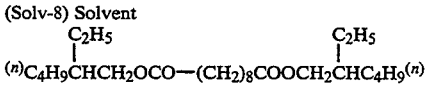

Preparation of Sample Nos. 102 to 141:

Sample Nos. 102 to 141 were prepared in the same manner as Sample No. 101, except that the cyan couplers incorporated in the red-sensitive emulsion layer and the order of arranging the light-sensitive emulsion layers were changed as shown in Table 1. In preparing each sample, the desired cyan coupler was added to each coating composition for the red-sensitive emulsion layer in the amount equimolar with the cyan couplers in Sample No. 101. In addition, the coverage of each coating composition was adjusted so that all the samples might be almost equal in the maximum density of the developed cyan color. Further, when using a four-equivalent coupler, the quantity of the emulsion added in preparing the coating composition was controlled so that the molar ratio of silver to the coupler might be 1.8 times that when using a two-equivalent coupler. Additionally, in Table 1, the arranging order of the light-sensitive emulsion layers is expressed using the initials of colors (that is, Y in case of yellow color, M in case of magenta color and C in case of cyan color) formed in the respective layers (namely, the fifth, third and first layers).

Moreover, the following coupler was used as another cyan coupler for comparison.

(RC-1) Coupler for comparison

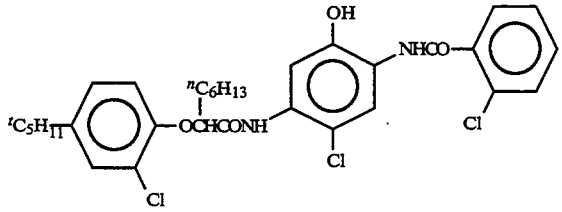

Processing and Evaluation of Samples:

The thus prepared samples were each subjected to gradation exposure through a red filter by means of a sensitometer (Model FWH, produced by Fuji Photo Film Co., Ltd., equipped with a light source having a color temperature of 3,200° K.). The exposure was carried out under a condition such that 0.1 second's exposure could provide the exposure amount of 250 CMS.

The exposed samples were subjected to photographic processing by means of a paper processor loaded with processing solutions having the respective compositions described below and working in accordance with the following processing steps.

| Processing Step | Temperature | Time | Amount* replenished | Tank Volume |
|---|---|---|---|---|
| Color development | 35° C. | 45 sec. | 161 ml | 17 l |
| Bleach-fix | 30–35° C. | 45 sec. | 215 ml | 17 l |
| Rinsing (1) | 30–35° C. | 20 sec. | — | 10 l |
| Rinsing (2) | 30–35° C. | 20 sec. | — | 10 l |
| Rinsing (3) | 30–35° C. | 20 sec. | 350 ml | 10 l |
| Drying | 70–80° C. | 60 sec. | | |

*per $m^2$ of photographic material (The rinsing baths (3), (2) and (1) were replenishedni that order in accordance with the three-stage counter current method.)

The composition of each processing solution used is described below.

| Color Developer: | Tank Solution | Replenisher |
|---|---|---|
| Water | 800 ml | 800 ml |
| Ethylenediamine-N,N,N',N'-tetra-methylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamido-ethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl)-hydroxylamine | 4.0 g | 5.0 g |
| Brightening agent (WHITEX 4B, produced by Sumitomo Chemical Co., Ltd.) | 1.0 g | 2.0 g |
| Water to make | 1,000 ml | 1,000 ml |
| pH (25° C.) adjusted to | 10.05 | 10.45 |

| Bleach-Fix Bath (Tank solution = Replenisher): | |
|---|---|
| Water | 400 ml |
| Ammonium thiosulfate (70%) | 100 ml |
| Sodium sulfite | 17 g |
| Ammonium ethylenediaminetetraacetatoferrate (III) | 55 g |
| Disodium ethylenediaminetetraacetate | 5 g |
| Ammonium bromide | 40 g |
| Water to make | 1,000 ml |
| pH (25° C.) adjusted to | 6.0 |

Rinsing Bath (Tank solution=Replenisher):

Ion exchange water (in which calcium and magnesium ion concentrations were each below 3 ppm).

each sample. These evaluation results are shown in Table 1.

TABLE 1

| Sample No. | Cyan Coupler | Layer Structure* 5th Layer | 3rd Layer | 1st Layer | Hue | Cyan Color formability Coverage ratio | Maximum developed color density ratio | Light Fastness | Note |
|---|---|---|---|---|---|---|---|---|---|
| 101 | ExC | C | M | Y | 0.34 | 1.0 | 1.00 | 0.72 | comparison |
| 102 | ExC | C | Y | M | 0.33 | 1.0 | 1.02 | 0.73 | " |
| 103 | ExC | Y | C | M | 0.35 | 1.0 | 1.01 | 0.70 | " |
| 104 | ExC | M | C | Y | 0.34 | 1.0 | 0.98 | 0.74 | " |
| 105 | ExC | Y | M | C | 0.36 | 1.0 | 1.00 | 0.77 | " |
| 106 | ExC | M | Y | C | 0.34 | 1.0 | 0.99 | 0.76 | " |
| 107 | RC-1 | C | M | Y | 0.42 | 1.0 | 1.10 | 0.51 | " |
| 108 | RC-1 | C | Y | M | 0.43 | 1.0 | 1.08 | 0.48 | " |
| 109 | RC-1 | Y | C | M | 0.44 | 1.0 | 1.07 | 0.53 | " |
| 110 | RC-1 | M | C | Y | 0.43 | 1.0 | 1.09 | 0.52 | " |
| 111 | RC-1 | Y | M | C | 0.45 | 1.0 | 1.08 | 0.55 | " |
| 112 | RC-1 | M | Y | C | 0.44 | 1.0 | 1.07 | 0.54 | " |
| 113 | (2) | C | M | Y | 0.30 | 0.6 | 1.04 | 0.52 | comparison |
| 114 | (2) | C | Y | M | 0.29 | 0.6 | 1.06 | 0.50 | " |
| 115 | (2) | Y | C | M | 0.31 | 0.6 | 1.02 | 0.68 | invention |
| 116 | (2) | M | C | Y | 0.30 | 0.6 | 1.05 | 0.70 | " |
| 117 | (2) | Y | M | C | 0.31 | 0.6 | 1.04 | 0.78 | " |
| 118 | (2) | M | Y | C | 0.29 | 0.6 | 1.05 | 0.76 | " |
| 119 | (11) | C | M | Y | 0.27 | 0.6 | 1.08 | 0.50 | comparison |
| 120 | (11) | C | Y | M | 0.26 | 0.6 | 1.08 | 0.48 | " |
| 121 | (11) | Y | C | M | 0.27 | 1.6 | 1.07 | 0.73 | invention |
| 122 | (11) | M | C | Y | 0.26 | 1.6 | 1.08 | 0.74 | " |
| 123 | (11) | Y | M | C | 0.28 | 1.6 | 1.06 | 0.82 | " |
| 124 | (11) | M | Y | C | 0.27 | 1.6 | 1.07 | 0.85 | " |
| 125 | (13) | C | M | Y | 0.30 | 1.6 | 1.01 | 0.49 | comparison |
| 126 | (13) | C | Y | M | 0.31 | 1.6 | 1.02 | 0.47 | " |
| 127 | (13) | Y | C | M | 0.31 | 1.6 | 1.03 | 0.69 | invention |
| 128 | (13) | M | C | Y | 0.29 | 1.6 | 1.01 | 0.70 | " |
| 129 | (13) | Y | M | C | 0.32 | 1.6 | 1.00 | 0.77 | " |
| 130 | (13) | M | Y | C | 0.30 | 1.6 | 1.01 | 0.78 | " |
| 131 | (16) | C | M | Y | 0.27 | 1.6 | 1.01 | 0.44 | comparison |
| 132 | (16) | Y | C | M | 0.26 | 1.6 | 1.08 | 0.64 | invention |
| 133 | (16) | M | C | Y | 0.28 | 0.6 | 1.06 | 0.66 | " |
| 134 | (16) | Y | M | C | 0.28 | 0.6 | 1.06 | 0.79 | " |
| 135 | (16) | M | Y | C | 0.26 | 0.6 | 1.07 | 0.82 | " |
| 136 | (20) | C | M | Y | 0.27 | 0.6 | 1.05 | 0.49 | comparison |
| 137 | (20) | M | C | Y | 0.25 | 0.6 | 0.98 | 0.70 | invention |
| 138 | (20) | Y | M | C | 0.26 | 0.6 | 0.99 | 0.83 | " |
| 139 | (23) | C | M | Y | 0.28 | 0.6 | 1.04 | 0.51 | comparison |
| 140 | (23) | M | C | Y | 0.27 | 0.6 | 1.03 | 0.69 | invention |
| 141 | (23) | M | Y | C | 0.27 | 0.6 | 1.02 | 0.84 | " |

*C, M and Y mean that the specified layers form cyan, magenta and yellow colors respectively.

The developed color densities of the thus processed samples were measured with a Fuji's densitometer, wherein red light or green light was used as irradiation light. For evaluating the hue of each sample, there was adopted the density measured with green light in the area having a density of 1.0 when measured with red light. This value for evaluation signifies the extent of an unnecessary absorption in the green region in comparison with the main absorption of the produced dye, so that the smaller value indicates that the cyan dye has the more excellent hue. The evaluation of color formability of each sample was made as follows: Each sample was examined for maximum developed-color density under exposure to red light, and a ratio of the maximum developed-color density of each sample to that of Sample No. 101 was employed as one evaluation value for the cyan color formability. As the other evaluation value for the cyan color formability, there was employed a ratio of the coverage of the coating composition for the red-sensitive emulsion layer in each sample to that in Sample No. 101. Further, each sample was exposed for 4 months by means of a fluorescent lamp (17,000 lux), and then the density in the area having a density of 1.5 when measured with red light before the exposure by means of the fluorescent lamp was examined. Using these density values, a discoloration rate was determined, and thereby was evaluated the light fastness of As can be seen from Table 1, the silver halide color photographic materials using the present cyan couplers were able to provide excellent hue of cyan dyes and high developed-color densities, and only when these photographic materials took the present layer structures was excellent light fastness ensured to the cyan dyes formed therein.

EXAMPLE 2

Preparation of Sample Nos. 201 to 237:

To examine the effect of a discoloration inhibitor on the light fastness of the cyan color developed, the known discoloration inhibitors illustrated below were added to coating compositions for red-sensitive emulsion layers respectively. In the addition, the coating compositions were chosen as shown in Table 2. Then, Sample Nos. 201 to 237 were prepared in the same manners as employed for preparing Samples in Example 1, except that the foregoing discoloration inhibitor-added coating compositions were used in place of the respective original ones. Therein, each discoloration inhibitor was added in a proportion of 50 mol % to the coupler used together.

Discoloration Inhibitor A

-continued

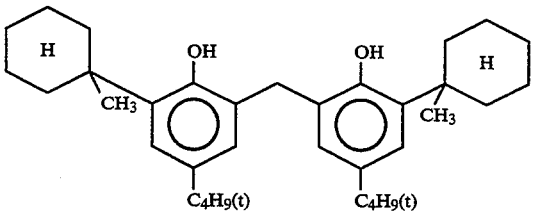

Discoloration Inhibitor B

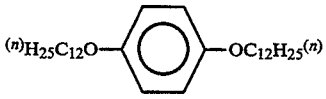

Discoloration Inhibitor C

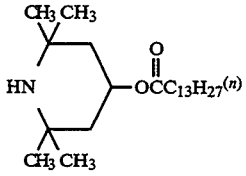

Discoloration Inhibitor D

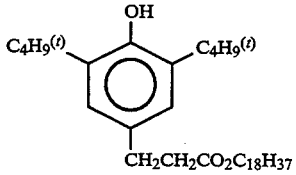

Processing and Evaluation of Samples:

The thus prepared samples were exposed and processed in the same manner as in Example 1, and then subjected to the same light fastness test as in Example 1. The results obtained are shown in Table 2.

TABLE 2

| Sample No. | Cyan Coupler | Discoloration Inhibitor | Layer Structure 5th Layer | 3rd Layer | 1st Layer | Light Fastness | Note |
|---|---|---|---|---|---|---|---|
| 201 | (11) | — | C | M | Y | 0.49 | comparison |
| 202 | (11) | A | C | M | Y | 0.72 | " |
| 203 | (11) | B | C | M | Y | 0.66 | " |
| 204 | (11) | C | C | M | Y | 0.68 | " |
| 205 | (11) | D | C | M | Y | 0.58 | " |
| 206 | (11) | — | M | C | Y | 0.74 | invention |
| 207 | (11) | — | M | Y | C | 0.84 | " |
| 208 | (11) | A | M | C | Y | 0.86 | " |
| 209 | (11) | C | M | C | Y | 0.79 | " |
| 210 | (11) | A | M | Y | C | 0.91 | " |
| 211 | (11) | B | M | Y | C | 0.87 | " |

TABLE 2-continued

| Sample No. | Cyan Coupler | Discoloration Inhibitor | Layer Structure 5th Layer | 3rd Layer | 1st Layer | Light Fastness | Note |
|---|---|---|---|---|---|---|---|
| 212 | (11) | C | M | Y | C | 0.89 | " |
| 213 | (11) | D | M | Y | C | 0.85 | " |
| 214 | (13) | — | C | M | Y | 0.49 | comparison |
| 215 | (13) | A | C | M | Y | 0.67 | " |
| 216 | (13) | C | C | M | Y | 0.69 | " |
| 217 | (13) | — | M | C | Y | 0.70 | invention |
| 218 | (13) | — | M | Y | C | 0.77 | " |
| 219 | (13) | A | M | C | Y | 0.78 | " |
| 220 | (13) | A | M | Y | C | 0.82 | " |
| 221 | (16) | — | C | M | Y | 0.44 | comparison |
| 222 | (16) | A | C | M | Y | 0.58 | " |
| 223 | (16) | C | C | M | Y | 0.55 | " |
| 224 | (16) | — | M | C | Y | 0.65 | invention |
| 225 | (16) | — | Y | M | C | 0.80 | " |
| 226 | (16) | A | Y | M | C | 0.85 | " |
| 227 | (16) | C | Y | M | C | 0.82 | " |
| 228 | (20) | — | C | M | Y | 0.50 | comparison |
| 229 | (20) | A | C | M | Y | 0.63 | " |
| 230 | (20) | — | M | C | Y | 0.70 | invention |
| 231 | (20) | — | Y | M | C | 0.82 | " |
| 232 | (20) | A | Y | M | C | 0.86 | " |
| 233 | (23) | — | C | M | Y | 0.51 | comparison |
| 234 | (23) | A | C | M | Y | 0.67 | " |
| 235 | (23) | — | M | C | Y | 0.70 | invention |
| 236 | (23) | — | M | Y | C | 0.84 | " |
| 237 | (23) | A | M | Y | C | 0.88 | " |

As can be seen from Table 2, the combined use of the present silver halide photographic materials with known discoloration inhibitors improved the light fastness of the cyan colors formed therein.

EXAMPLE 3

To examine the effect of cyan coupler solvents, Sample Nos. 301 to 318 were prepared in the same manner as in Example 1, except that only Solv-6 used as cyan coupler solvent was replaced by other solvents set forth in Table 3 respectively. Herein, every substitute solvent was used in the same amount (by weight) as Solv-6.

Processing and Evaluation of Samples:

The thus prepared samples were exposed and processed in the same manner as in Example 1, and then subjected to the same light fastness test as in Example 1. The hue and the light fastness of the processed samples were evaluated by the same methods as employed in Example 1 respectively. The results obtained are shown in Table 3. In addition, the processed samples were examined for maximum densities of three kinds of developed colors, and the maximum densities of each developed color are shown as relative values in Table 3, with Sample No. 101 prepared in Example 1 being taken as 1.00.

TABLE 3

| Sample No. | Cyan Coupler | Solvent | Arrangement Order of Light-sensitive Layers 5th Layer | 3rd Layer | 1st Layer | Hue | Relative Maximum Densities of Developed Colors Cyan | Magenta | Yellow | Light Fastness | Note |
|---|---|---|---|---|---|---|---|---|---|---|---|
| 301 | (11) | Solv-5 | C | M | Y | 0.29 | 1.07 | 0.97 | 0.95 | 0.50 | comparison |
| 302 | (11) | Solv-5 | C | Y | M | 0.28 | 1.08 | 0.95 | 0.94 | 0.47 | " |
| 303 | (11) | Solv-5 | M | C | Y | 0.30 | 1.08 | 1.00 | 0.98 | 0.72 | invention |
| 304 | (11) | Solv-5 | Y | C | M | 0.28 | 1.07 | 0.98 | 1.01 | 0.71 | " |
| 305 | (11) | Solv-5 | M | Y | C | 0.27 | 1.06 | 1.00 | 0.99 | 0.82 | " |
| 306 | (11) | Solv-5 | Y | M | C | 0.28 | 1.07 | 1.00 | 1.00 | 0.83 | " |
| 307 | (11) | Solv-8 | C | M | Y | 0.29 | 1.07 | 0.96 | 0.90 | 0.48 | comparison |
| 308 | (11) | Solv-8 | M | C | Y | 0.30 | 1.06 | 1.01 | 0.97 | 0.70 | invention |
| 309 | (11) | Solv-8 | Y | M | C | 0.28 | 1.06 | 1.00 | 0.98 | 0.82 | " |
| 310 | (11) | Solv-2 | C | M | Y | 0.26 | 1.06 | 0.97 | 0.95 | 0.51 | comparison |
| 311 | (11) | Solv-2 | Y | C | M | 0.28 | 1.06 | 0.99 | 1.01 | 0.71 | invention |

TABLE 3-continued

| Sample No. | Cyan Coupler | Solvent | Arrangement Order of Light-sensitive Layers 5th Layer | 3rd Layer | 1st Layer | Hue | Relative Maximum Densities of Developed Colors Cyan | Magenta | Yellow | Light Fastness | Note |
|---|---|---|---|---|---|---|---|---|---|---|---|
| 312 | (11) | Solv-2 | M | Y | C | 0.27 | 1.07 | 1.01 | 0.99 | 0.80 | " |
| 313 | (20) | Solv-5 | C | M | Y | 0.27 | 0.99 | 0.97 | 0.96 | 0.46 | comparison |
| 314 | (20) | Solv-5 | M | C | Y | 0.26 | 0.98 | 1.00 | 0.99 | 0.68 | invention |
| 315 | (20) | Solv-5 | M | Y | C | 0.26 | 0.98 | 1.00 | 1.00 | 0.80 | " |
| 316 | (20) | Solv-8 | C | M | Y | 0.27 | 1.00 | 0.95 | 0.92 | 0.49 | comparison |
| 317 | (20) | Solv-8 | Y | C | M | 0.29 | 0.99 | 0.99 | 0.98 | 0.70 | invention |
| 318 | (20) | Solv-8 | Y | M | C | 0.27 | 0.99 | 0.98 | 0.98 | 0.81 | " |
| 101 | ExC | Solv-6 | C | M | Y | 0.34 | 1.00 | 1.00 | 1.00 | 0.72 | comparison |

As can be seen from Table 3, the silver halide color photographic materials according to embodiments of the present invention had improved hue and light fastness even when different solvents were used as the cyan coupler solvent. Although the light-sensitive emulsion layer which contained the cyan coupler of the present invention, when situated in a position further from the support caused a remarkable drop in the developed-color density of the light-sensitive emulsion layer present in the position lower than said layer, this problem was almost solved by arranging the light-sensitive layers according to the present embodiments.

EXAMPLE 4

The samples prepared in Example 1 were examined for reduction discoloration resistance.

Processing and Evaluation of Samples:

Each of the samples prepared in Example 1 was subjected to gradation exposure through separation filters for sensitometry. The exposure was carried out under a condition such that 0.1 second's exposure could provide the exposure amount of 250 CMS.

Continuous processing (running test) was performed using the thus exposed samples and the same paper processor as used in Example 1, which was loaded with the same processing solutions as used in Example 1, until the quantity of the replenisher supplied to the color developer became twice the volume of the color developing tank.

Some of the samples prepared in Example 1 were exposed to red light, and development-processed using the color developer which had undergone the foregoing running test. At the conclusion of the photographic processing, the resulting samples each were examined for reduction discoloration resistance in accordance with the following method. Specifically, the maximum density of the cyan color developed in each sample was measured with a Fuji densitometer just after the photographic processing, and then each sample was dipped in an N2 solution, CN16 (produced by Fuji Photo Film Co., Ltd.), for 5 minutes, followed by washing and subsequent drying operations. Thereafter, the maximum density of cyan color in each sample was measured again. Thus, the reduction discoloration resistance of each sample was evaluated by the equation defined as follows, and expressed in terms of per cent (%):

$$\text{Reduction Discoloration Resistance} = \frac{\text{Maximum Developed-Color Density just after Processing with Running Solution}}{\text{Maximum Developed-Color Density after 5 Minutes's Dipping in N2 Solution}} \times 100$$

At the conclusion of the above-described running test, the Fe(II) ion concentration in the bleach-fix bath was determined by the colorimetry with bathophenathroline. As a result of it, about 15% of iron ions present as Fe(III) ions at the beginning of the running test was detected as Fe(II) ions. Additionally, the pH of the bleach-fix bath was 6.1 at the conclusion of the running test.

The reduction discoloration resistance of each sample was shown in Table 4.

TABLE 4

| Sample No. | Reduction Discoloration Resistance (%) | Note |
|---|---|---|
| 101 | 98 | comparison |
| 103 | 87 | " |
| 105 | 86 | " |
| 113 | 100 | " |
| 114 | 99 | " |
| 115 | 100 | invention |
| 116 | 100 | " |
| 117 | 100 | " |
| 118 | 100 | " |
| 119 | 100 | comparison |
| 122 | 99 | invention |
| 123 | 100 | " |
| 136 | 100 | comparison |
| 137 | 100 | invention |
| 138 | 100 | " |
| 139 | 100 | comparison |
| 140 | 100 | invention |
| 141 | 100 | " |

As can be seen from Table 4, the silver halide color photographic materials according to the present invention were excellent in reduction discoloration resistance also.

EXAMPLE 5

Samples are prepared in the same manner as in Example 1, except that the yellow coupler contained in the blue-sensitive emulsion layer is changed from ExY to Y-18 and the coverage of the blue-sensitive emulsion layer is reduced to 80% of the coverage employed in Example 1. The thus obtained samples are subjected to the same tests as carried out in Example 1 and Example 2 to give similar results. In addition, the densities of yellow color developed in these samples are almost the same as those in the samples prepared in Example 1.

EXAMPLE 6

Samples are prepared in the same manner as in Example 1, except that the support is changed from the reflective support to a transparent one (a polyethylene terephthalate film provided with an undercoat) and every light-sensitive emulsion layer is increased in the coverage thereof by a factor of 2.5, and subjected to the same tests as carried out in Example 1 and Example 3 to give similar results. That is, the effects of the present invention can be secured in a silver halide color photographic material using a transparent support, too.

In accordance with embodiments of the present invention, which involve using the cyan coupler represented by general formula (Ia) in a light-sensitive emulsion layer arranged in a specified order, the resulting silver halide color photographic materials can improve on conventional ones with respect to color formability, hue of the cyan dye and light fastness of the cyan color image.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having on a reflective support at least a cyan coupler-containing silver halide emulsion layer, a magenta coupler-containing silver halide emulsion layer and a yellow coupler-containing silver halide emulsion layer, said cyan coupler-containing silver halide emulsion layer being present in a position nearer to the support than at least either the magenta coupler-containing silver halide emulsion layer or the yellow coupler-containing silver halide emulsion layer and containing as said cyan coupler at least one compound represented by the following general formula (Ia):

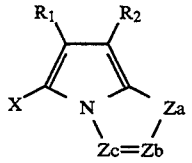

(Ia)

wherein Za represents —NH— or —CH($R_3$)—; Zb and Zc each represent —C($R_4$)= or —N=; $R_1$, $R_2$ and $R_3$ each represent an electron-withdrawing group having a Hammett's substituent constant $\sigma_p$ of at least 0.20, provided that the sum of the $\sigma_p$ values or $R_1$ and $R_2$ is at least 0.65; $R_4$ represents a hydrogen atom or a substituent group, and when two $R_4$'s are present in the formula they may be the same or different; and X represents a hydrogen atom or a group capable of splitting off by the coupling reaction with the oxidation product of an aromatic primary amine color developing agent, wherein the cyan coupler-containing silver halide emulsion layer, the magenta coupler-containing silver halide emulsion layer and the yellow coupler-containing silver halide emulsion layer each comprises silver chloride or silver chlorobromide having a chloride content of at least 90 mole % which is substantially free from silver iodide.

2. The silver halide color photographic material of claim 1, wherein $R_1$, $R_2$ and $R_3$ each represents an electron-withdrawing group having a Hammett's substituent constant of $\sigma_p$ of not greater than 1.0.

3. The silver halide color photographic material of claim 1 wherein $R_1$, $R_2$ and $R_3$ are selected from the groups consisting of an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenoalkyl group, a halogenoalkoxy group, a halogenoaryloxy group, a halogenoalkylamino group, a halogenoalkylthio group, an aryl group substituted with other electron withdrawing groups having a $\sigma_p$ value of at least 0.20, a heterocyclyl group, a halogen atom, an azo group, and a selenocyanate group.

4. The silver halide color photographic material of claim 1 wherein $R_1$ is a cyano group and $R_2$ is an alkoxycarbonyl group.

5. The silver halide color photographic material of claim 1 wherein $R_1$ is a cyano group and $R_2$ is a trifluoromethyl group.

6. The silver halide color photographic material of claim 1 wherein $R_1$ is a cyano group and $R_2$ is an aryloxycarbonyl group.

7. The silver halide color photographic material of claim 1 wherein $R_4$ is selected from the groups consisting of an alkyl group, an aryl group, a heterocyclyl group, a cyano group, a nitro group, an acylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocyclyloxy group, an acyloxy group, a carbamoyloxy group, an aryloxycarbonylamino group, an imido group, a heterocyclylthio group, a sulfinyl group, a phosphonyl group, an acyl group and an azolyl group.

8. The silver halide color photographic material of claim 1 wherein X is selected from the group consisting of a halogen atom, an alkoxy group, an aryloxy group, an alkylthio group, an arylthio group, an arylsulfonyl group, an arylsulfinyl group or a 5- or 6-membered nitrogen-containing heterocyclyl group which is attached to the coupling active site via the nitrogen thereof.

9. The silver halide color photographic material of claim 1 wherein said cyan coupler of formula (Ia) is selected from one of the following formulae:

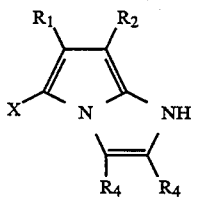

(IIa)

-continued (IIIa)

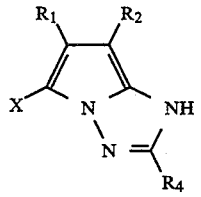

(IVa)

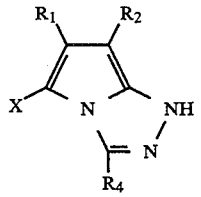

(Va)

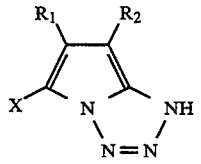

(VIa)

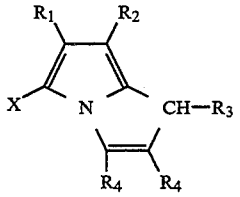

(VIIa)

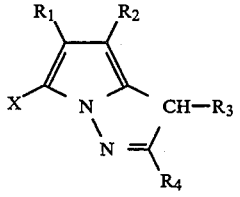

(VIIIa)

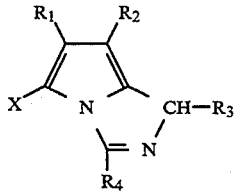

(IXa)

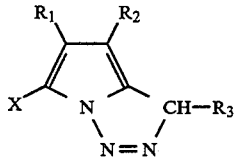

wherein $R_1$, $R_2$, $R_3$, $R_4$ and X have the same meanings as in general formula (Ia), respectively.

10. The silver halide color photographic material of claim 1 wherein said cyan coupler of formula (Ia) is a dimer of formula (Ia).

11. The silver halide color photographic material of claim 1 wherein said cyan coupler is a homopolymer or a copolymer of an addition polymerizable ethylenic compound containing repeating units of general formula (Ia).

12. The silver halide color photographic material of claim 11 wherein said homopolymer or copolymer is selected from the group of acrylic acid esters, methacrylic acid esters and maleic acid esters.

13. The silver halide color photographic material of claim 1 wherein said couplers are present in the photographic material at concentrations between 0.001 to 1.0 mole per mole of silver halide.

14. The silver halide color photographic material of claim 13 wherein said yellow coupler is present at a concentration between 0.01 to 0.5 mole per mole of silver halide.

15. The silver halide color photographic material of claim 13 wherein said magenta coupler is present at a concentration between 0.003 to 0.5 mole per mole of silver halide.

16. The silver halide color photographic material of claim 13 wherein said cyan coupler is present at a concentration between 0.002 to 0.5 mole per mole of silver halide.

17. The silver halide color photographic material of claim 1 further comprising at least one other cyan coupler.

18. The silver halide color photographic material of claim 1, wherein the cyan coupler-containing silver halide emulsion layer comprises a dispersed emulsion of the cyan coupler dissolved in a high boiling organic solvent having a dielectric constant of at least 4.2.

19. The silver halide color photographic material of claim 18, wherein the high boiling organic solvent has a dielectric constant of no greater than 20.

20. A silver halide color photographic material having on a reflective support at least a cyan coupler-containing silver halide emulsion layer, a magenta coupler-containing silver halide emulsion layer and a yellow coupler-containing silver halide emulsion layer, said cyan coupler-containing silver halide emulsion layer being present in a position nearer to the support than at least either the magenta coupler-containing silver halide emulsion layer or the yellow coupler-containing silver halide emulsion layer and containing as said cyan coupler at least one compound represented by the following general formula (Ia):

(Ia)

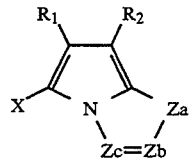

wherein Za represents —NH— or —CH($R_3$)—; Zb and Zc each represent —C($R_4$)= or —N=; $R_1$, $R_2$ and $R_3$ each represent an electron-withdrawing group having a Hammett's substituent constant $\sigma_p$ of at least 0.20, provided that the sum of the $\sigma_p$ values or $R_1$ and $R_2$ is at least 0.65; $R_4$ represents a hydrogen atom or a substituent group, and when two $R_4$'s are present in the formula they may be the same or different; and X represents a hydrogen atom or a group capable of splitting off by the coupling reaction with the oxidation product of an aromatic primary amine color developing agent, wherein the cyan coupler-containing silver halide emulsion layer, the magenta coupler-containing silver halide emulsion layer and the yellow coupler-containing silver halide emulsion layer each comprises silver chloride or silver chlorobromide having a chloride content of at least 90 mole % which is substantially free from silver iodide, said reflection-type multilayer color photographic material being subjected to bleach-fix processing after development.

* * * * *